US008186413B2

(12) United States Patent
Fujita et al.

(10) Patent No.: US 8,186,413 B2
(45) Date of Patent: May 29, 2012

(54) CONTROL SYSTEM FOR ARCHITECTURAL COVERINGS WITH REVERSIBLE DRIVE AND SINGLE OPERATING ELEMENT

(75) Inventors: Suzanne M. Fujita, Louisville, CO (US); Paul A. Pedri, Westminster, CO (US); Stephen P. Smith, Denver, CO (US); Stephen T. Wisecup, Erie, CO (US)

(73) Assignee: Hunter Douglas Inc., Pearl River, NY (US)

( * ) Notice: Subject to any disclaimer, the term of this patent is extended or adjusted under 35 U.S.C. 154(b) by 329 days.

(21) Appl. No.: 12/523,332

(22) PCT Filed: Jan. 4, 2008

(86) PCT No.: PCT/US2008/050249

§ 371 (c)(1),
(2), (4) Date: Jul. 16, 2009

(87) PCT Pub. No.: WO2008/094720

PCT Pub. Date: Aug. 7, 2008

(65) Prior Publication Data

US 2010/0018656 A1 Jan. 28, 2010

Related U.S. Application Data

(60) Provisional application No. 60/887,045, filed on Jan. 29, 2007.

(51) Int. Cl.
*E06B 9/11* (2006.01)

(52) U.S. Cl. ..... 160/121.1; 160/319

(58) Field of Classification Search ..... 160/121.1, 160/319, 84.04, 84.05
See application file for complete search history.

(56) References Cited

U.S. PATENT DOCUMENTS

| | | | | |
|---|---|---|---|---|
| 5,791,393 | A * | 8/1998 | Judkins | 160/321 |
| 5,890,529 | A | 4/1999 | Haarer | |
| 5,918,658 | A | 7/1999 | Schartner | |
| 6,112,800 | A | 9/2000 | Marusak | |
| 6,129,131 | A | 10/2000 | Colson | |
| 2004/0226663 | A1 | 11/2004 | Smith et al. | |
| 2006/0118248 | A1 | 6/2006 | Anderson et al. | |
| 2006/0272783 | A1 * | 12/2006 | Smith et al. | 160/121.1 |

* cited by examiner

*Primary Examiner* — David Purol
(74) *Attorney, Agent, or Firm* — Dorsey & Whitney LLP

(57) ABSTRACT

A retractable covering for an architectural opening is reversibly driven through an input assembly, a transmission and an output assembly by a reciprocal operating cord that can be pulled down by an operator and will automatically retract while the covering is held in a predetermined position. While the input assembly is always driven in a first direction, a transmission is shifted between two operative positions through movement of a shift arm depending upon the positioning of the shift arm by the operating cord. The shift arm is pivotal about an axis parallel with a roller for the covering and when the operating cord is pulled straight downwardly, the covering is moved in an upwardly or retracting direction while if the operating cord is pulled downwardly and toward the operator, i.e. away from the architectural opening, the covering is driven in a downwardly or extending direction.

18 Claims, 34 Drawing Sheets

CONTROL SYSTEM FOR ARCHITECTURAL COVERINGS WITH REVERSIBLE DRIVE AND SINGLE OPERATING ELEMENT

CROSS REFERENCE TO RELATED APPLICATION

This is a Patent Cooperation Treaty patent application claiming priority to U.S. provisional application No. 60/887,045 filed Jan. 29, 2007, the disclosure of which is hereby incorporated by reference in its entirety.

FIELD OF THE INVENTION

The present invention relates to retractable coverings for architectural openings. More particularly, the present invention relates to operating systems for controlling retractable coverings for architectural openings using a single reciprocating operating element for driving the covering between extended and retracted positions.

BACKGROUND OF THE INVENTION

Operating systems utilized in window coverings for architectural openings, such as shade and blind assemblies, are commonly used. Conventional shade and blind assemblies typically comprise a head rail, bottom rail, and slats or a covering disposed there between. Generally, a control system for raising and lowering such blinds or shades is installed in the head rail and may include an operating element, such as a cord, for lowering or raising the blinds or shades. The operating element is typically connected to pulleys or drums within the head rail, which when activated by a user, lift the bottom rail or lower the bottom rail via cords attached to the bottom rail. The operating element may be a continuous loop so as to present to the user a convenient method for operating the shade or blind. Other control systems may have a plurality of operating elements that are not in a loop so as to present the user a choice of one of the operating elements to raise or lower the blind. Other control systems, such as the cord lock system, may employ a single operating element that is not in a loop, is used to both raise and lower the blind, and is locked into place by a pivoting lock that directly engages and binds the cord (i.e., operating element).

Whether the control system utilizes a single looped type operating element or a plurality of operating elements, the operator must choose which direction to pull the loop or which operating element to activate in order to move the architectural covering in a desired direction. This can be especially confusing if the operating elements are tangled.

Inherent in the loop-operating element and cord lock systems is the problem of having a very long operating element with which to operate the system. Often, a greater length of operating element is necessary to raise or lower the shade or blind due to the longer drop of the shade or blind. A greater length of the operating element or the use of a looped cord present strangulation hazard to children who may become entangled in the operating element.

U.S. patent application Ser. No. 10/791,645, which was filed Mar. 1, 2004 and is hereby incorporated in its entirety into the present application, discloses a novel control system that addresses many of the aforementioned problems associated with window covering operating systems. However, said control system is not configured such that it is compatible with every operating system for a window covering. Also, improvements in operational smoothness and dependability would be beneficial.

There is a need in the art for a control system offering improved operational smoothness and dependability while addressing the aforementioned challenges related to moving window coverings. There is also a need in the art for a method of using and making such a control system.

BRIEF SUMMARY OF THE INVENTION

The present invention, in one embodiment, is a control system for a roller tube equipped retractable covering for architectural openings. The control system employs a single operating element (i.e., cord, cable, chain, etc.) that is retractable, i.e. reciprocally movable. To lower the covering, the operating element is repeatedly pulled/extended in a first downward direction/path, the control system automatically retracting the operating element after each pull/extension. To raise the covering, the operating element is repeatedly pulled/extended in a second downward direction/path, the control system automatically retracting the operating element after each pull/extension.

The present invention provides for retractable coverings for architectural openings utilizing a control system having a single operating element allowing a user to drive a retractable covering for architectural openings in both directions between extended and retracted positions by imparting a repetitive motion to the operating element. When the retractable covering is vertically disposed, a user can raise or lower the retractable covering by imparting a repetitive up and down motion to the pull cord. The invention is similar in some respects to the system described in U.S. patent application Ser. No. 11/420,274, filed May 25, 2006, and entitled Control System For Architectural Coverings With Reversible Drive and Single Operating Element which is commonly owned with the present application and is hereby incorporated by reference.

In one aspect of the present invention, a covering for an architectural opening includes a head rail assembly, at least one sheet of fabric, and a head roller rotatably supported by the head rail assembly and adapted to extend or retract the at least one sheet upon rotation of the head roller in a first direction or a second direction. A control system is connected with the head rail assembly and is adapted to rotate or drive the head roller in the first direction and the second direction. The control system includes an input assembly, a reversible transmission, and an output assembly. The input assembly includes a single operating element and is operative to convert linear motion of the operating element into rotational motion of a first motion transfer element. The transmission is operative to translate rotation of the first motion transfer element into rotation of a second motion transfer element in either of two desired output rotational directions. The output assembly is operatively engaged with the second motion transfer element to rotate the head roller. A pull force applied in a first pull direction/path imparted on the single operating element causes the head roller to rotate in the first direction, and the pull force applied in a second pull direction/path imparted on the single operating element causes the head roller to rotate in the second direction.

More specifically, the transmission is operative to translate rotation of the first motion transfer element in the first direction into rotation of a second motion transfer element through at least one planet gear rotatably connected with a planet carrier. The output assembly is operatively engaged with the second motion transfer element to rotate the head roller. The input assembly includes a braking element adapted to brake the planet carrier to cause rotation of the second motion transfer element in the second direction, and the input assembly is adapted to release the planet carrier to cause rotation of the second motion transfer element in the first direction.

The transmission is operative to translate rotation of the first motion transfer element in the first direction into rotation of a second motion transfer element though a planetary gear set configured to selectively operate in a first configuration and a second configuration. The output assembly is operatively engaged with the second motion transfer element to rotate the head roller. The first configuration provides a first mechanical advantage and causes the second motion transfer element to rotate at a first speed. The second configuration provides a second mechanical advantage and causes the second motion transfer element to rotate at a second speed.

The transmission is also operative to translate rotation of the first motion transfer element into rotation of a second motion transfer element through a clutch and at least one third gear or clutch plates. The output assembly is operatively engaged with the second motion transfer element to rotate the head roller. Rotation of the first motion transfer element in the first direction engages the least one third gear to activate the clutch to cause rotation of the second motion transfer element in the first direction. The clutch is configured to allow rotation of the second motion transfer element in the first direction and second direction when the clutch is deactivated.

As mentioned, the output assembly is operatively engaged with the second motion transfer element to rotate the head roller. The input assembly is configured to engage the transmission to cause the head roller to rotate in the first direction when the operating element travels in a first path through the input assembly, and is configured to engage the transmission to cause the head roller to rotate in a second direction when the operating element travels in a second path through the input assembly.

The input assembly includes a shift arm having a pawl adapted to engage ratchet teeth on the planet carrier when a pull force in a first pull direction is imparted on the single operating element. The input assembly is also configured to automatically retract the single operating element into the head rail assembly and disengage the pawl from the ratchet teeth when no pull force is applied to the single operating element.

The input assembly comprises the operating element, a spool around which the operating element is wrapped, a biasing element, and a shift arm. The spool is rotatably mounted on a first axle and adapted to storably receive the operating element. The biasing element is coupled to the spool and adapted to cause the spool to retract the operating element from an extended state onto the spool. The shift arm is pivotally mounted on a second axle and includes a pawl tooth and a first slide surface for engaging the operating element. The operating element extends from the spool directly across the slide surface and through a trigger finger on the shift arm. Displacement of the operating element in a first direction brings the operating element into contact with the trigger finger and causes the shift arm to pivot such that the pawl tooth is prevented from engaging the transmission. Displacement of the operating element in a second direction allows the shift arm to pivot such that the pawl tooth engages the transmission.

Pawl tooth engagement with the transmission causes the transmission to provide rotational output in the second rotational direction. Failure of the pawl tooth to engage with the transmission causes the transmission to provide rotational output in the first rotational direction.

The features, utilities, and advantages of the invention will be apparent from the following more particular description of embodiments of the invention as illustrated in the accompanying drawings and defined in the appended claims.

DETAILED DESCRIPTION OF THE INVENTION

I. Discussion of First Embodiment a. General Overview of First Embodiment

Retractable coverings for architectural openings are well known in the art. Such retractable coverings are generally movable between extended and retracted positions. When such coverings are vertically oriented, they are moveable between raised and lowered positions. Retractable coverings may also include vanes or slats, which are typically movable or tiltable between open and closed positions. A head rail typically houses a control system to allow a user to move the retractable covering between retracted and extended positions. As such, the retractable covering may be suspended from the head rail, and may include a bottom rail with vanes or slats disposed between the head rail and the bottom rail. The control system may include an operating element, such as a pull cord, to allow a user to operate the control system. Operation of the control system causes the retractable covering to move.

The present invention provides for a control system having a single operating element allowing a user to move the retractable covering between extended and retracted positions by imparting a repetitive motion to the operating element. For example, when the retractable covering is vertically disposed, a user can raise or lower the retractable covering by imparting a repetitive up and down motion to the pull cord. While the present invention is described below in connection with a covering of the type shown in FIG. 1, it is to be appreciated the present invention is applicable to other types of devices for covering architectural openings.

b. Covering

Figure 1:
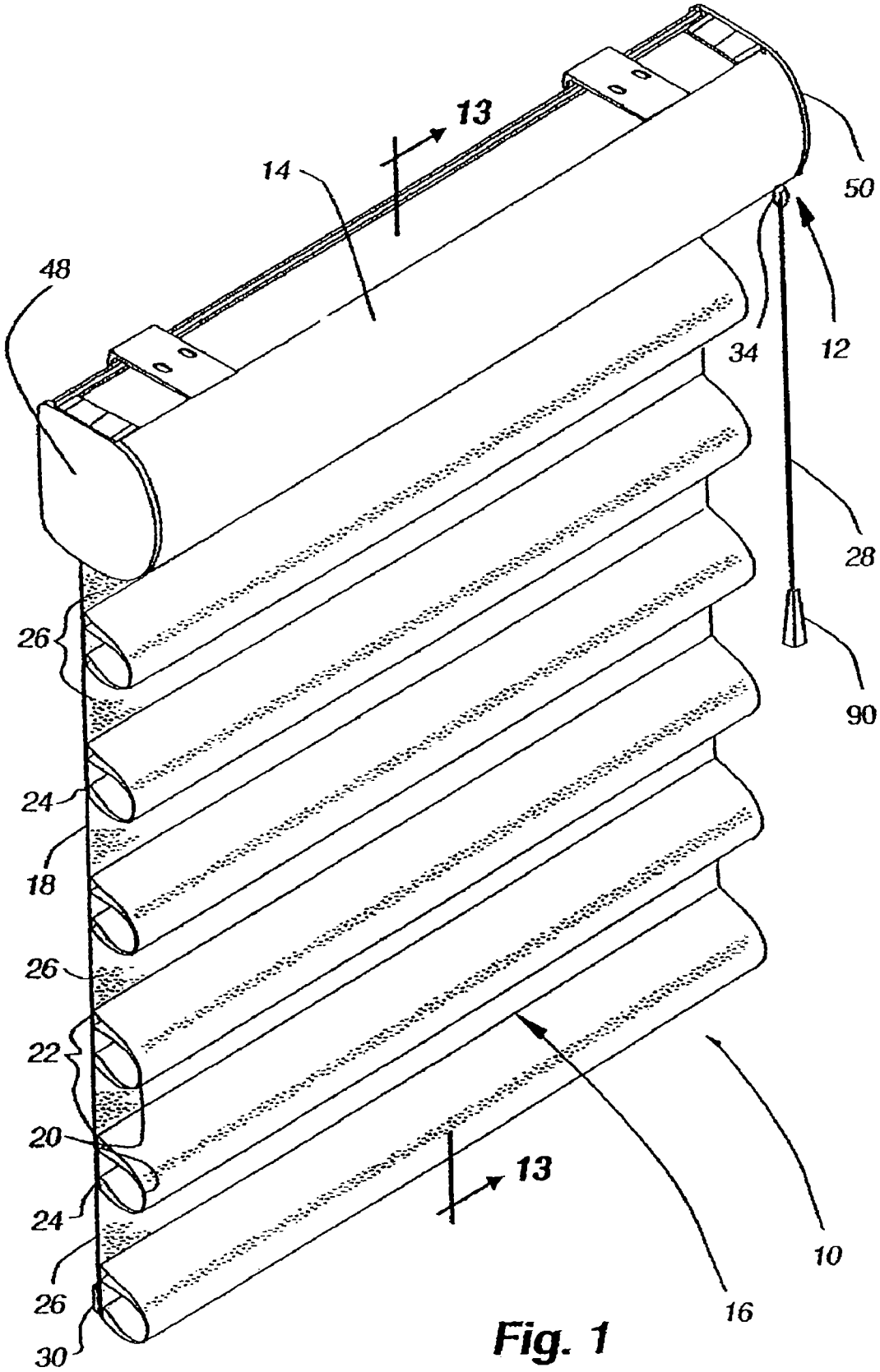
FIG. 1 is an isometric view of a covering for an architectural opening incorporating the control system of the present invention.

With reference to FIG. 1, the covering 16 illustrated for purposes of describing the control system 12 of the present invention can be seen to include a headrail 14 in which operative components of the control system are confined and a retractable and flexible fabric that can be extended across an architectural opening in which the covering is mounted or retracted onto a roller 40 within the headrail. As will be appreciated with the description hereafter, the roller is reversibly driven with the control system to extend or retract the covering.

Figure 13:
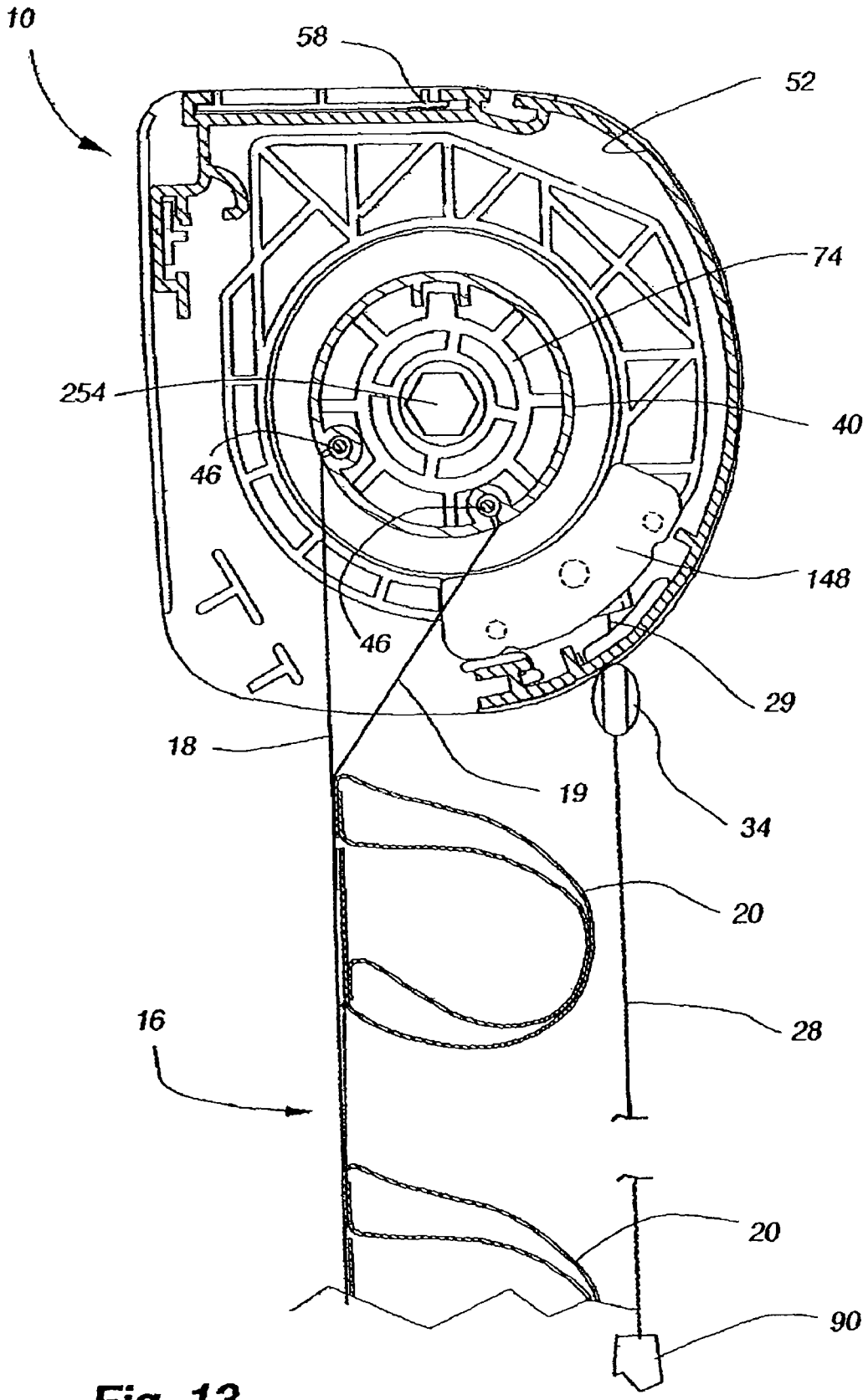
FIG. 13 is an enlarged fragmentary section taken along line 13-13 of FIG. 1.

The fabric is comprised of a support structure illustrated as being a sheet of flexible material such as sheer fabric to which is secured a plurality of double-layered vanes which define loops of fabric secured along a top edge to the support sheet 18 in a horizontal orientation and vertically spaced from adjacent identical vanes 20. The lower edge 24 of each vane is connected to flexible operating elements cords 19 (FIG. 13) which are also secured to the roller 40 and are operative with selected movement of the roller to raise or lower the lower edge of each vane while the upper edge 22 of each vane remains fixed relative to the support sheet 18. When the lower edge of each vane is raised, a gap 26 is defined between the vanes 20 through which vision is allowed to pass through the support sheet but when the lower edge of each vane is lowered, it overlaps an underlying vane to block vision and light through the fabric. Accordingly, the vanes are typically made of an opaque material while the support sheet is a transparent or translucent material. A more detailed description of a covering of the type illustrated in FIG. 1 is shown in U.S. patent application Ser. No. 11/102,500, filed Apr. 8, 2005 and entitled Retractable Shade With Collapsible Vanes, which is of common ownership with the present invention and the disclosure of which is hereby incorporated by reference.

c. Control System

FIGS. 25-33 illustrate how the control system 12 is operated to raise the covering 16, and FIGS. 34-42 illustrate how the control system is operated to lower the covering. Direction of movement of the covering, either upward or downward, is dictated by the generally downward direction in which the user pulls on the pull cord 28. More particularly, the downward direction in which the user pulls on the pull cord, which can be selectively angled within a plane substantially perpendicular to the flexible fabric, causes the control system to engage and rotate the head roller to either wrap or unwrap the covering, which causes the bottom rail 30 to move up or down, respectively. In addition, the control system allows a user to repeatedly pull on the pull cord 28 in the same downward direction to place the covering 16 in a desired position.

The control system 12, for illustrative purposes, is located on the right end cap 50. In order to raise the covering 16, as shown in FIGS. 25-33, a user grasps the pull cord 28 and pulls straight downwardly in a substantially vertical direction 32 with respect to the head rail assembly. This motion will be referred to hereafter as an upward operating pull direction where the control system engages to rotate the head roller in a direction to raise the covering. As the user pulls on the pull cord in the upward operating pull direction, the operating cord 29 is pulled from the control system housed in the head rail assembly. The distance a user may pull the pull cord is limited by the length of the operating cord. Once the user releases the pull cord, the control system automatically retracts the operating cord back into the head rail assembly until a stopper and coupler 34 on the pull cord abuts the head rail assembly.

Figure 25:
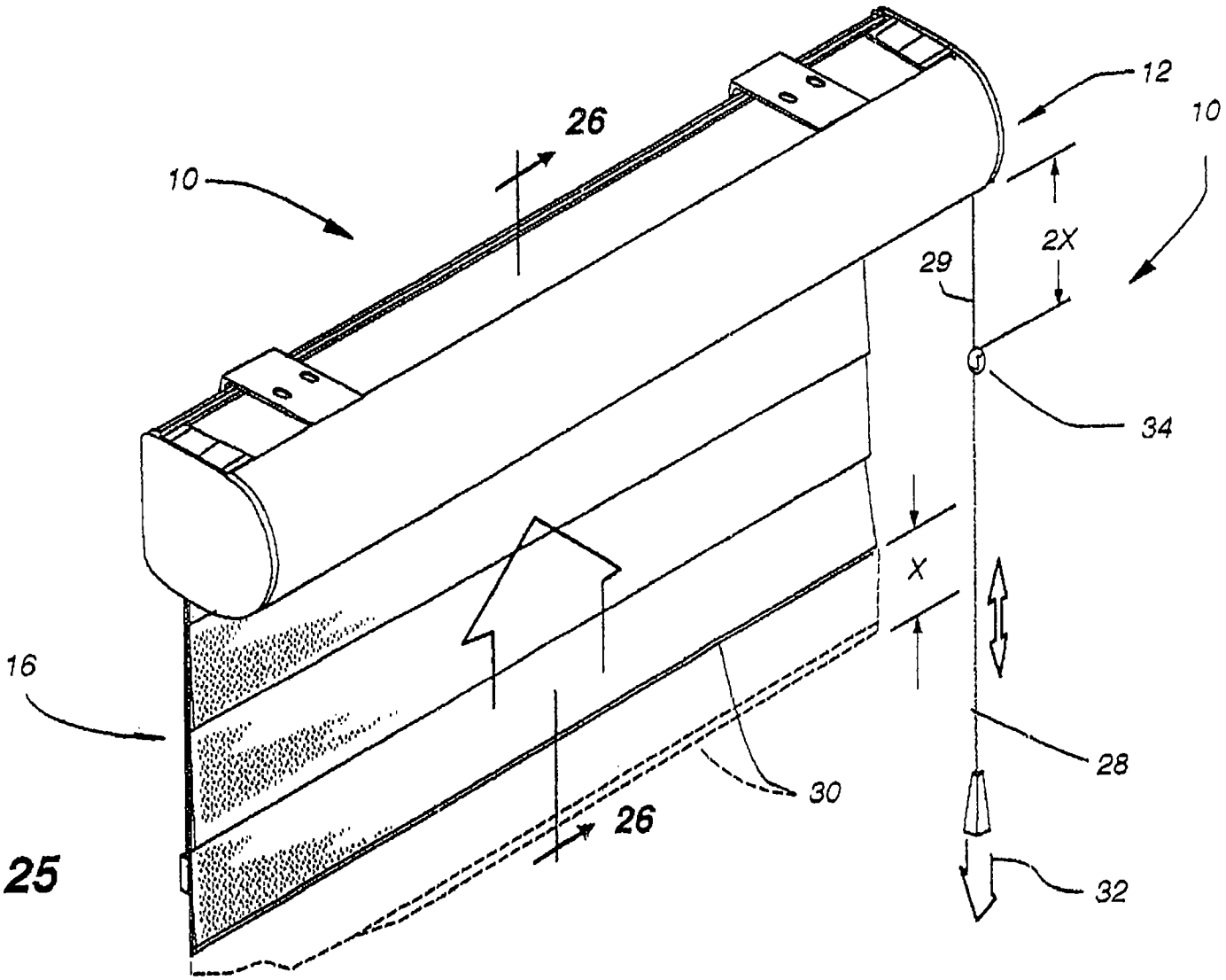
FIG. 25 is an isometric of the covering of FIG. 1 shown in a retracting or raising position.
Figure 26:
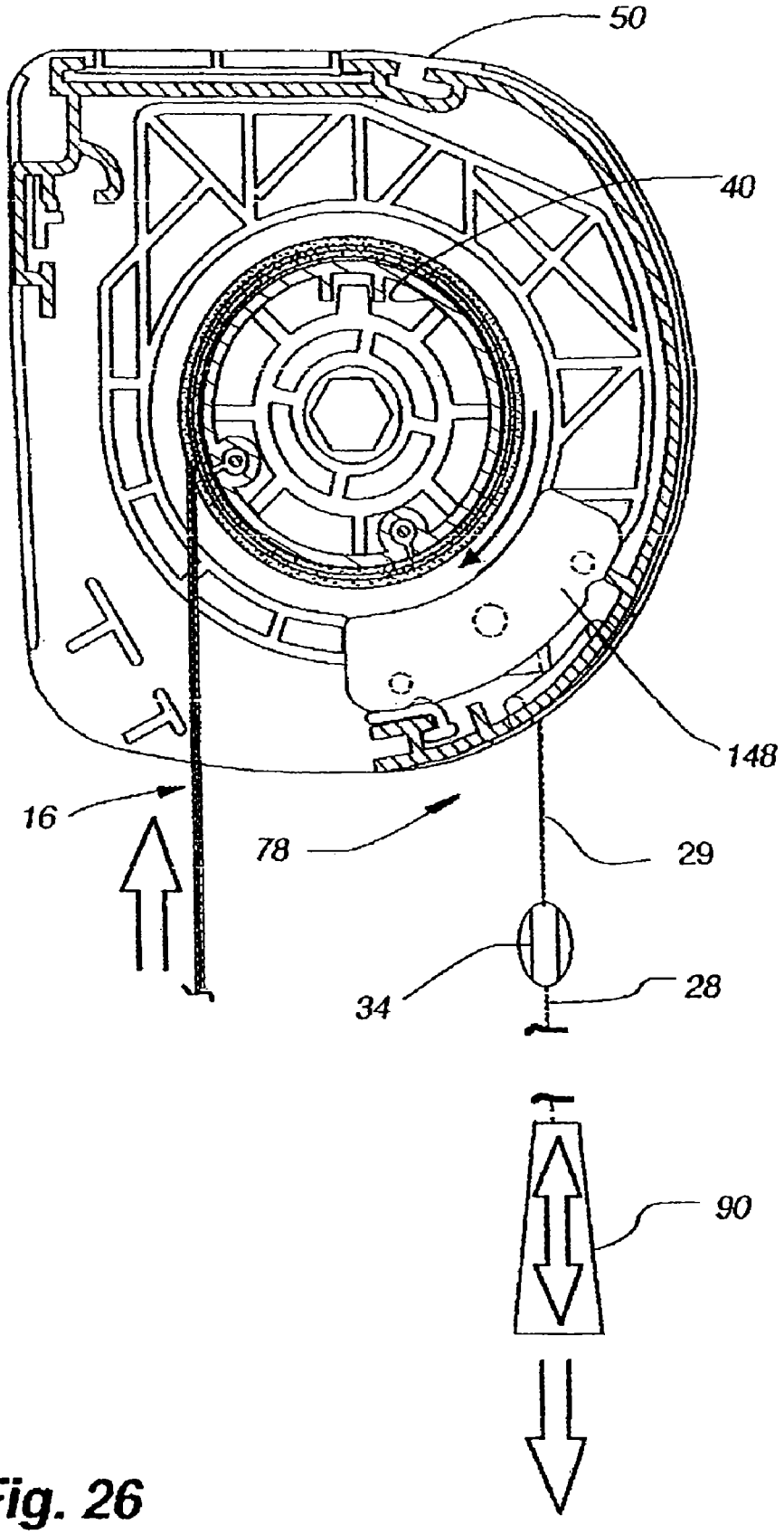
FIG. 26 is an enlarged section taken along line 26-26 of FIG. 25.
Figure 27:
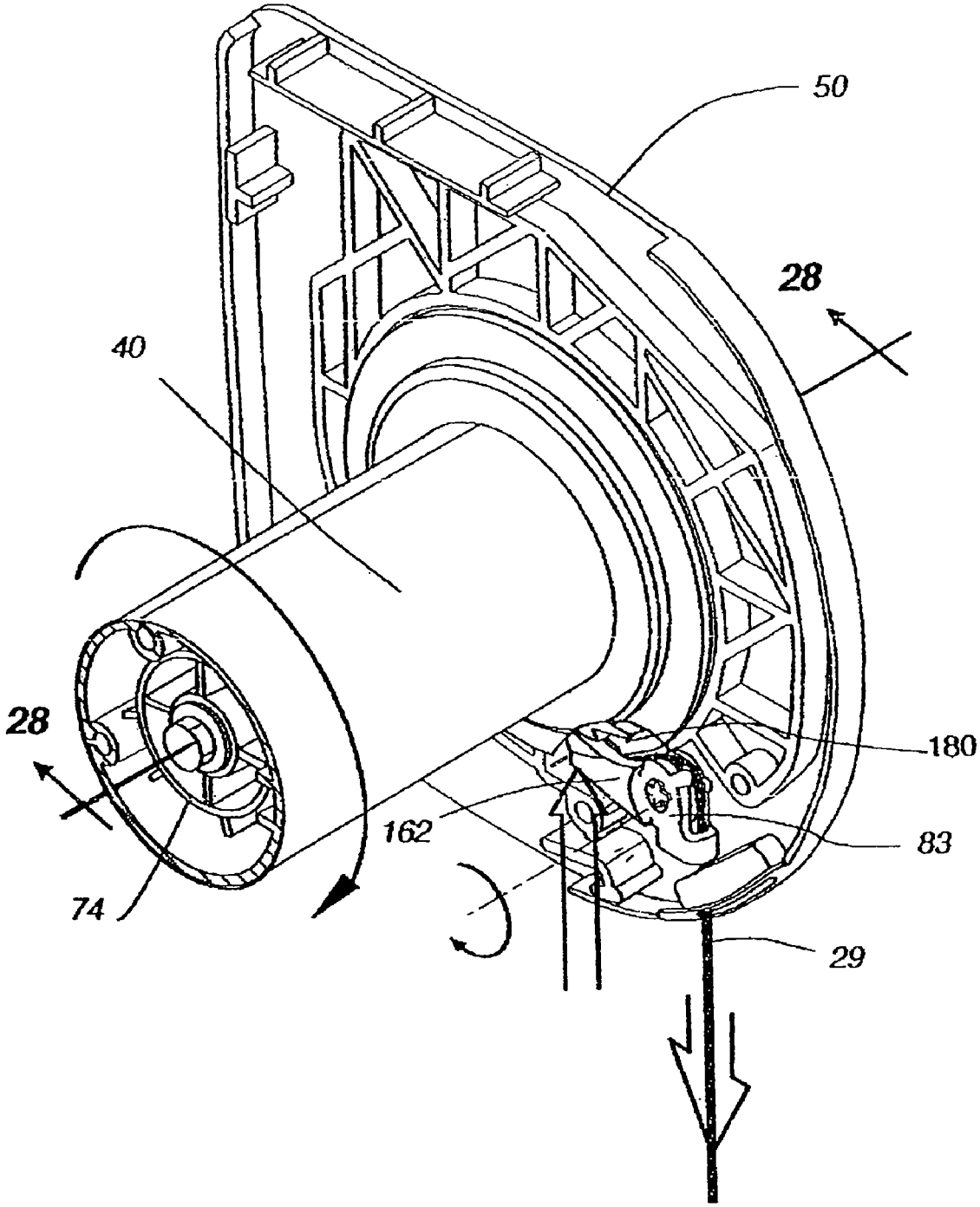
FIG. 27 is an isometric similar to FIG. 14 showing the control system being operated to raise the covering and with certain elements removed for clarity.

As shown in FIGS. 25-33, the upward distance the bottom rail 30 moves is dictated by the distance the pull cord 28 is pulled, the rotational mechanical advantage provided by the control system, and the diameter of the head roller 40. The mechanical configuration of the control system and the diameter of the head roller combine to determine the upward distance the covering moves in response to a distance that the pull cord is pulled. As such, in one embodiment, the control system mechanical configuration and the head roller diameter combine to provide increased mechanical advantage and reduced speed when raising the covering and increased speed in the downward direction where operating force requirements are less. For example, as shown in FIG. 25, the control system configuration and the head roller diameter are such that they provide a 2:1 mechanical advantage. As a result, in order to move the covering an upward distance of "X," the pull cord must be pulled a distance of "2X." As can be understood by those skilled in the art, a wide range of other mechanical advantages are possible depending on the combination of the control system mechanical configuration and the head roller diameter.

Once the bottom rail 30 is raised to the desired position, the user may release the pull cord 28. Upon release of the pull cord, the pull cord is automatically retracted into the head rail assembly by the control system. The control system also includes a braking feature to hold the covering in position once the user releases tension from the pull cord. If the user pulls the pull cord such that the operating cord 29 is extended to its full length, and the bottom rail does not move the desired distance upward, the user can allow the pull cord to retract into the head rail and then pull again on the pull cord to continue raising the bottom rail. This process can be repeated until the bottom rail has reached the desired position.

In order to lower the covering 16, as shown in FIGS. 34-42, a user grasps the pull cord 28 and pulls downwardly and in a slightly forward direction 36 toward the user and away from the fabric in a plane substantially perpendicular with the fabric to move the covering in the downward direction, also referred to as the downwardly operating pull direction 38. As discussed in more detail below, by pulling in the downwardly operating pull direction, the control system engages to rotate the head roller in a direction to lower the covering. The distance a user may pull the pull cord is limited by the length of the operating cord 29, and the control system automatically retracts the pull cord back into the head rail assembly until the stopper or coupler abuts the head rail assembly once the user releases the pull cord.

Figure 34:
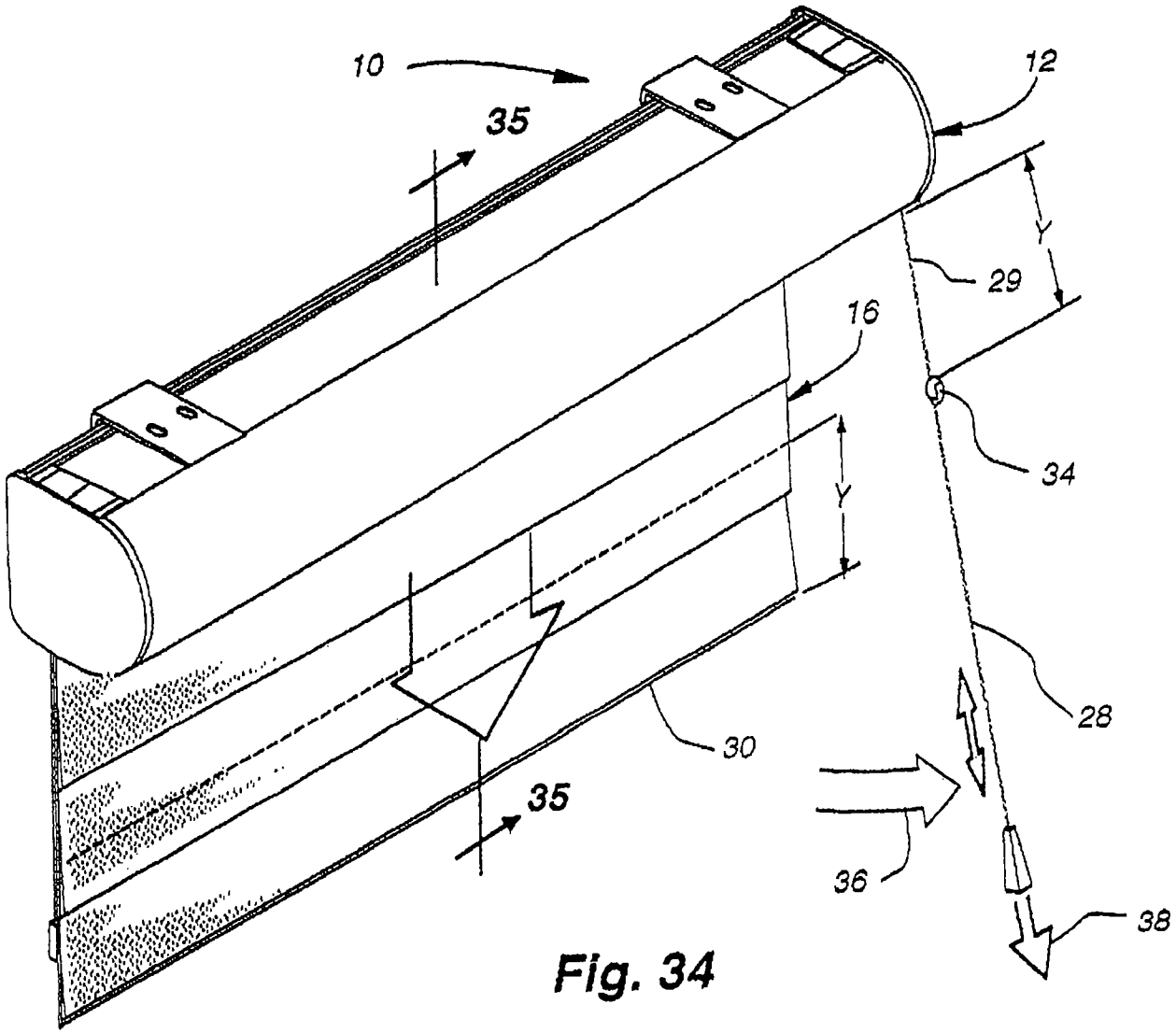
FIG. 34 is an isometric of the covering of FIG. 1 being operated in an extending or lowering operation.
Figure 35:
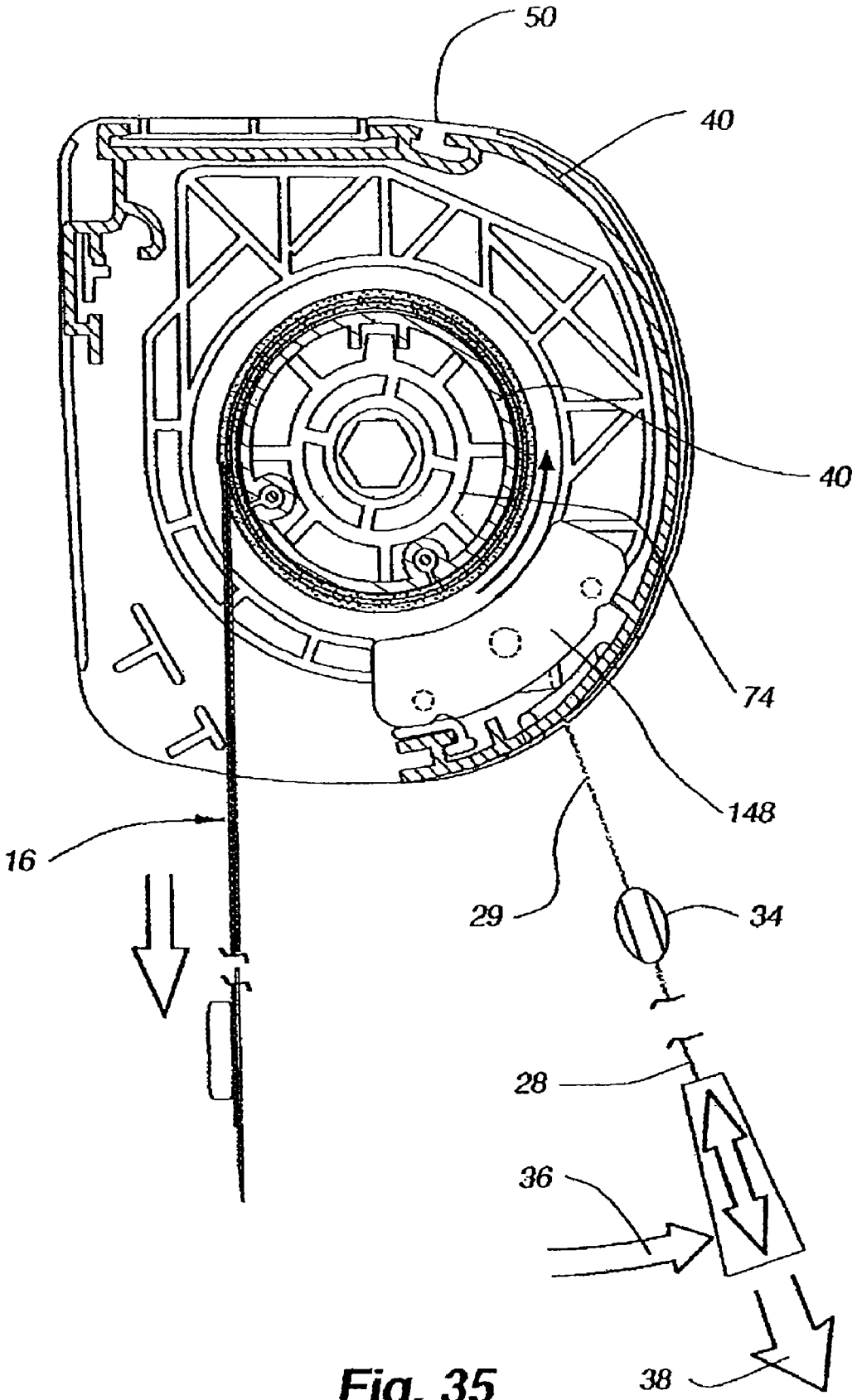
FIG. 35 is an enlarged section taken along line 35-35 of FIG. 34.
Figure 36:
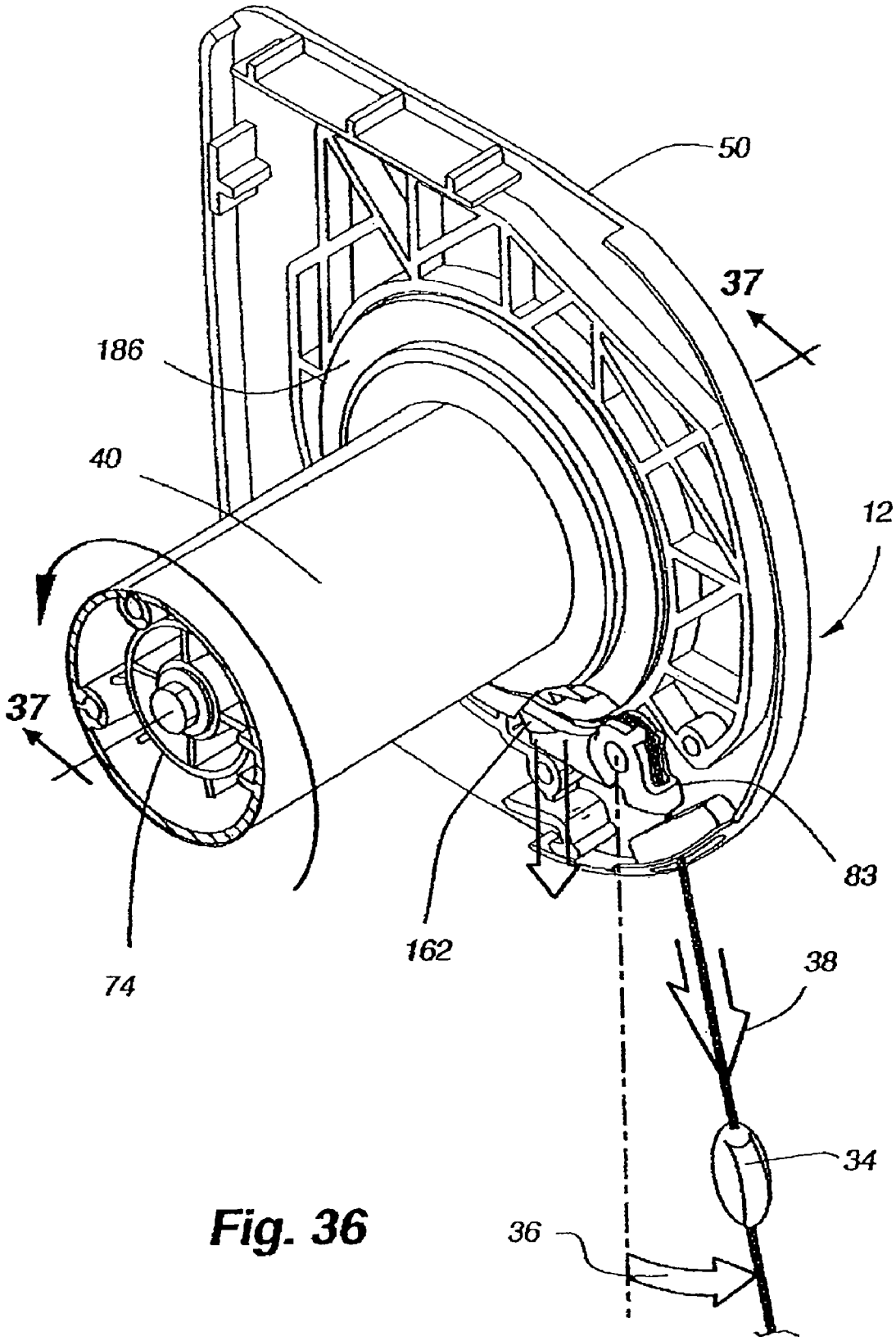
FIG. 36 is an isometric similar to FIG. 27 showing the control system being operated to lower or extend the covering.

As shown in FIG. 34, the downward distance "Y" the bottom rail moves is dictated by the distance the pull cord 28 is pulled, the mechanical advantage provided by the control system, and the diameter of the head roller. As similarly described above with reference to upward movement of the covering, the mechanical configuration of the control system and the diameter of the head roller combine to determine the downward distance the covering moves in response to a distance that the operating cord 29 is pulled. For example, as shown in FIG. 34, the control system configuration and the head roller diameter are such that they provide a 1:1 mechanical advantage. As a result, in order to move the covering 16 a downward distance of "Y," the pull cord 28 must be pulled a distance of "Y." As can be understood by those skilled in the art, a wide range of other mechanical advantages are possible depending on the combination of the control system 12 mechanical configuration and the head roller diameter. Also, the present invention can be configured to provide identical or different mechanical advantages for upward 32 and downward 38 movement of the covering.

Once the bottom rail 30 is lowered to the desired position, the user may release the pull cord 28. Upon release of the pull cord, it is automatically retracted into the head rail assembly by the control system 12. The control system's braking feature mentioned above holds the covering 16 in position once the user releases tension from the pull cord. If the user pulls the pull cord such that it is extended to its full length and the bottom rail does not move the desired distance downward, the user can allow the pull cord to retract into the head rail and then pull again on the pull cord to continue lowering the bottom rail. This process can be repeated until the bottom rail has reached a desired position.

d. Head Roller and Fabric Covering Connected Thereto

Figure 2:
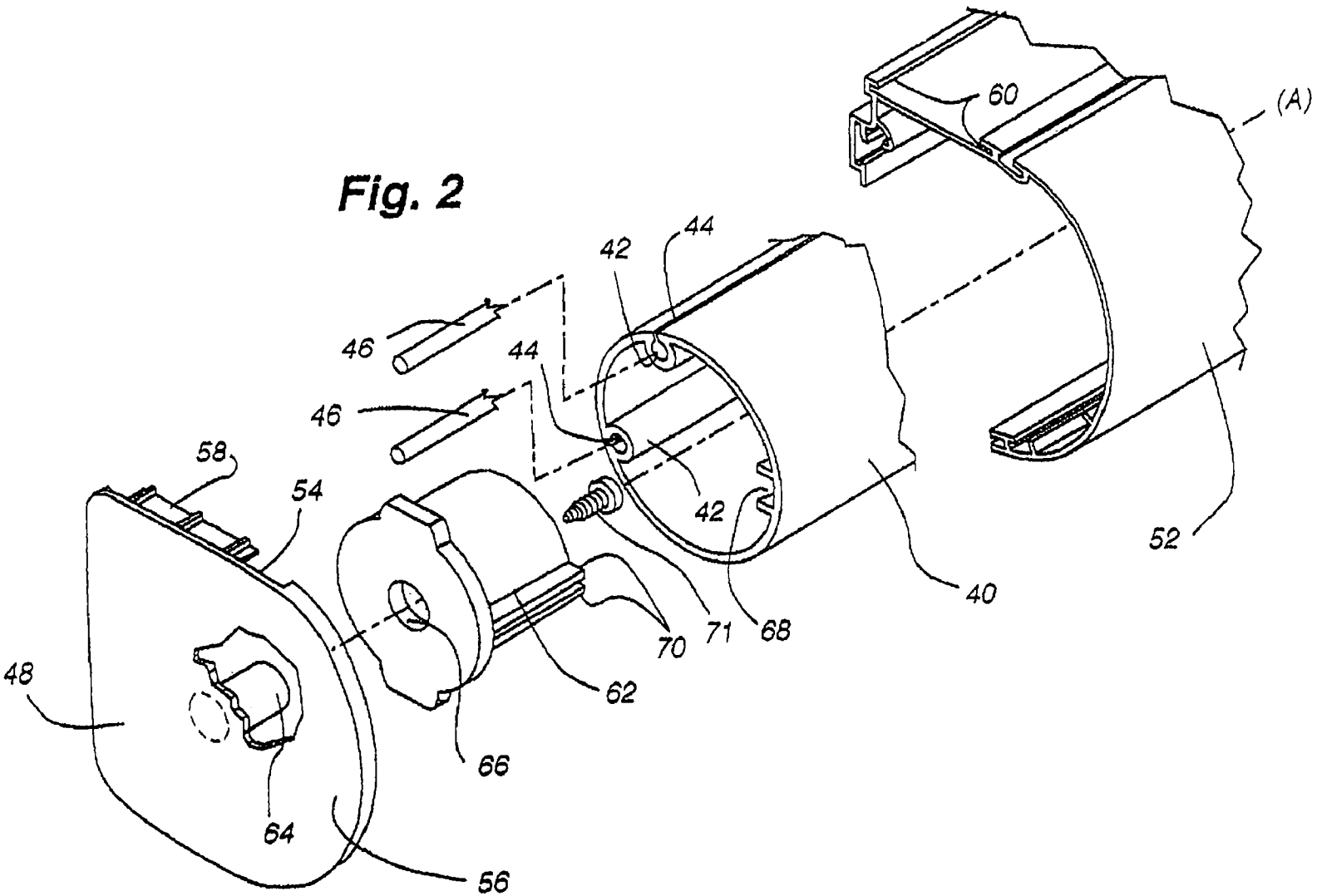
FIG. 2 is an exploded isometric of the left end of the head rail including components of the control system.
Figure 15:
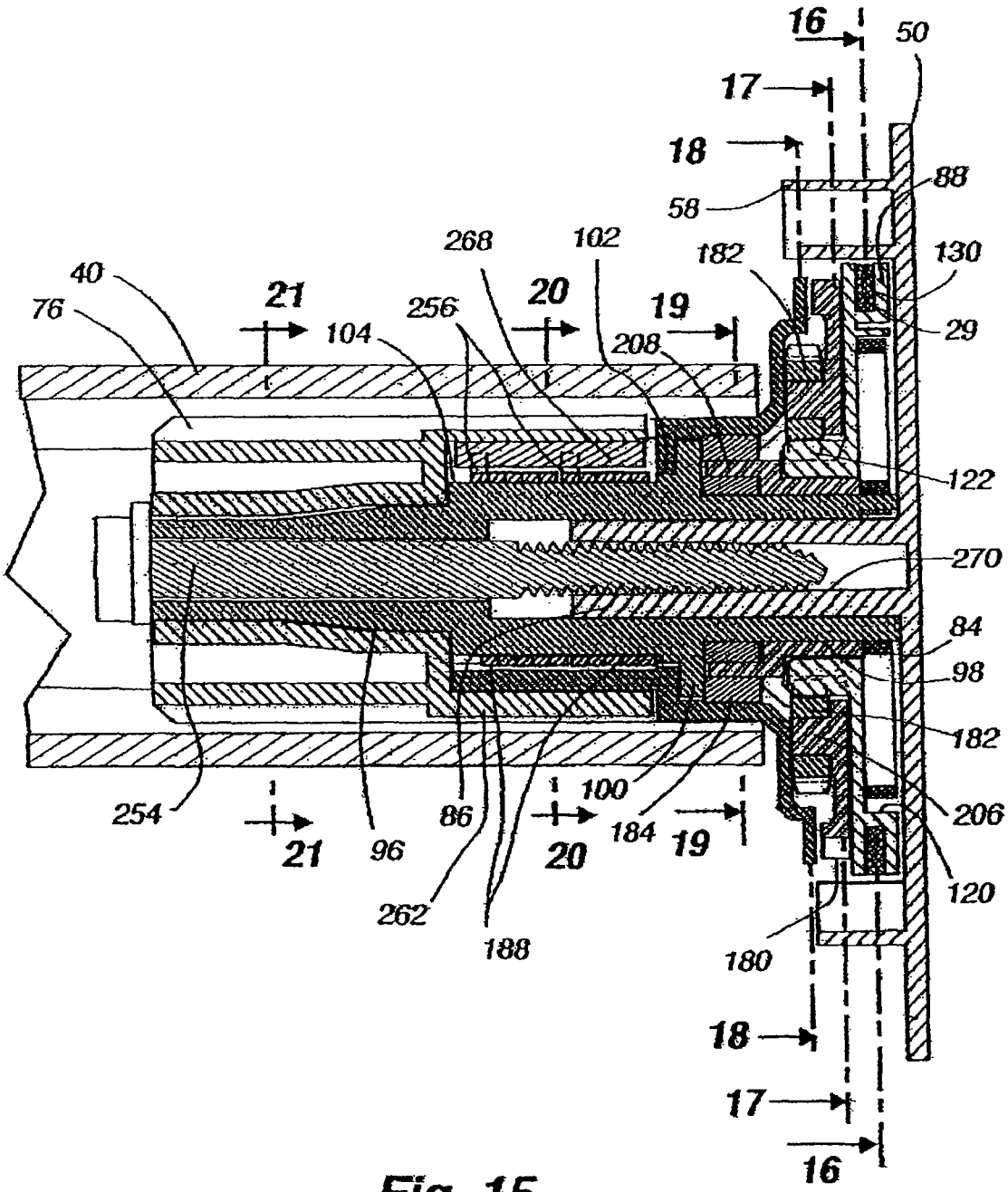
FIG. 15 is an enlarged section taken along line 15-15 of FIG. 14.

As previously mentioned, the fabric for the covering is connected with the head roller 40, and depending upon which direction the head roller rotates, the covering 16 is either wrapped onto the head roller or unwrapped from the head roller. As shown in FIGS. 2 and 15, the head roller is hollow and generally of tubular-shape. The head roller is provided with two interior longitudinal round openings 42.

As illustrated in FIG. 2, each interior round opening 42 has a narrow opening 44 on the outer surface of the head roller 40. Each opening extends longitudinally along the entire length of the head roller and is adapted to anchor the upper end of either the support sheet 18 or the operating element. The fabric support sheet and the lift or operating elements 19 of the covering 16 are provided with round rods 46 adapted to fit inside the openings 42 of the exterior openings and held in position by the diameter of the interior openings. The rods 46 can be made from stiff material, such as metal or plastic.

The fabric support sheet 16 and the operating elements are connected with the head roller 40 by sliding the rods 46 into the interior openings 44 from either end of the head roller, such that the fabric sheet and the operating elements exit the exterior channels through the narrow opening. It is to be appreciated that the head roller and the fabric sheet 18 may utilize various configurations to connect the head roller with the fabric sheet.

e. Head Rail Assembly

Figure 3:
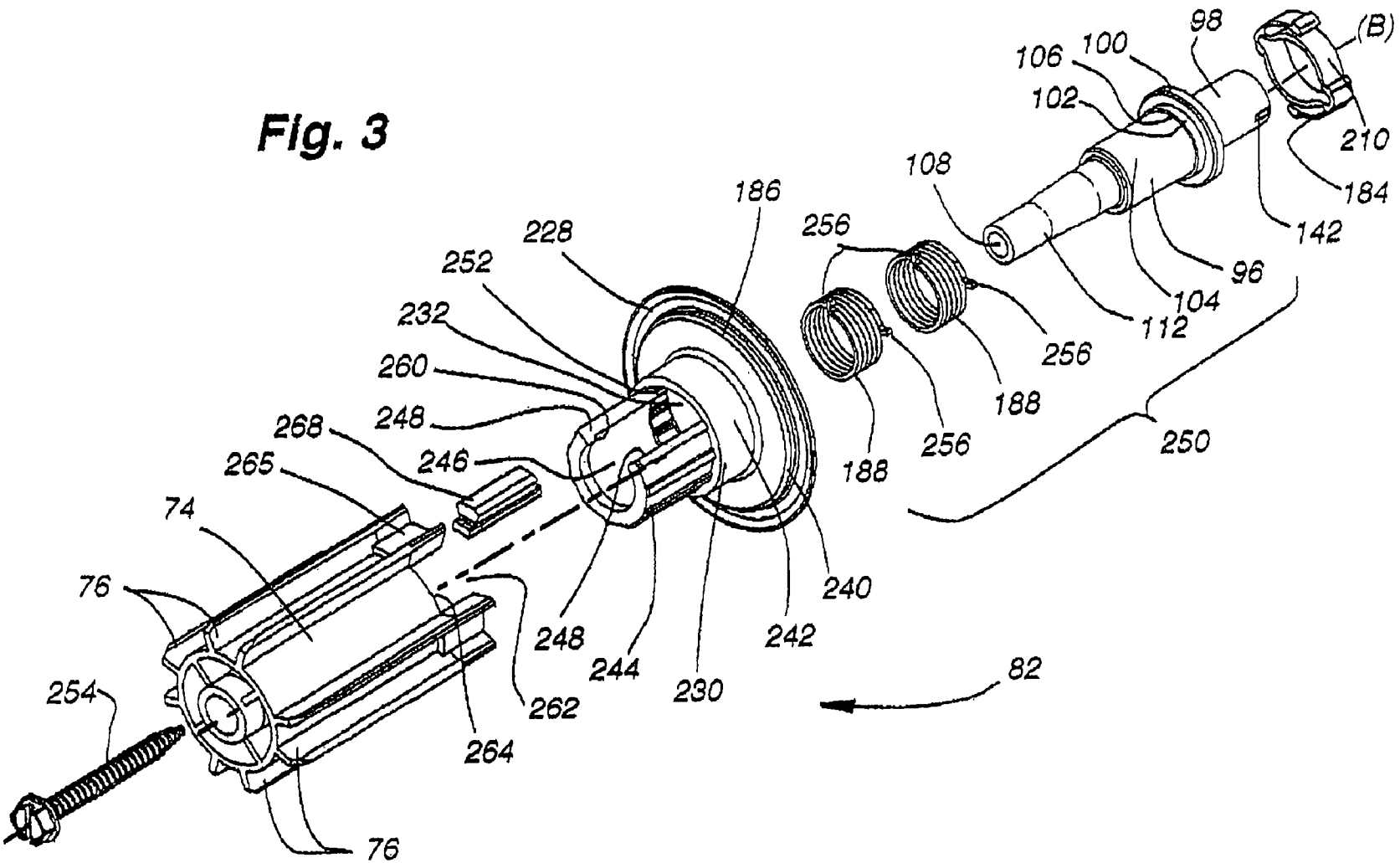
FIG. 3 is an exploded isometric of an intermediate portion of the control system forming an extension of the control system component shown in FIG. 2.
Figure 4:
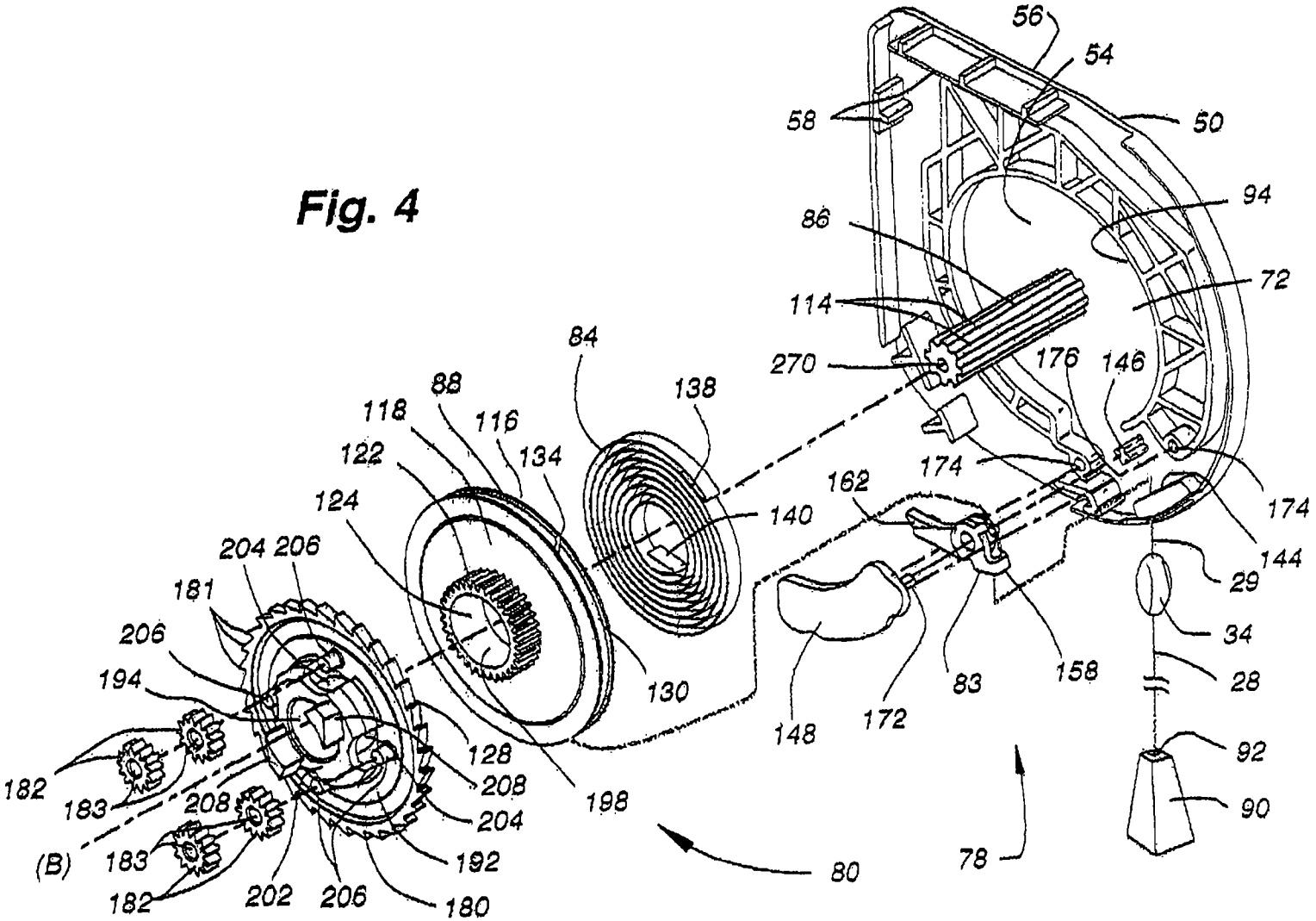
FIG. 4 is an exploded isometric similar to FIGS. 2 and 3 showing the right end components of the control system as a continuation of the components shown in FIGS. 2 and 3.
Figure 9:
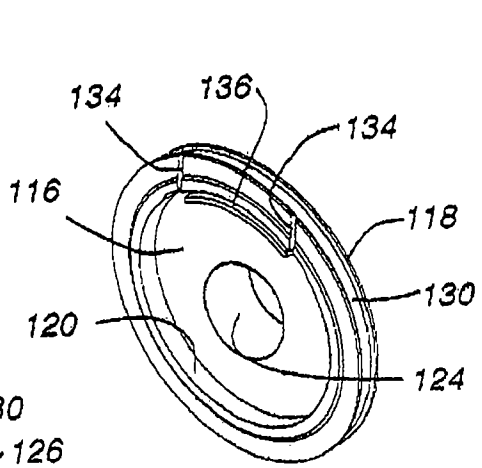
FIG. 9 is an isometric of the cord spool component of the control system.
Figure 8:
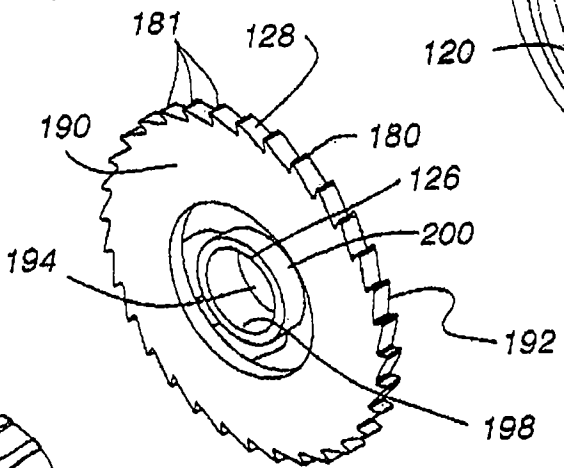
FIG. 8 is an isometric of the carrier component of the control system.

As shown in FIGS. 2-4, a left end cap 48 and the right end cap 50 fasten to edges of a front rail 52. The left end cap and the right end cap also have an inner side 54 and outer side. Extended edges 58 extend perpendicularly from the inner sides of the left end cap and the inner side of the right end cap and are adapted to be press fit into slots 60 located on the front rail. It is to be appreciated that extended edges 58 may be configured differently for various shaped front rails. The head roller 40 is supported from the head rail assembly (shown in FIGS. 2 and 14) by the control system 12 connected with the right end cap 50 and a generally cylindrical extension 62 rotatably connected with the left end cap 48. Although the present invention is depicted and described with the control system connected with the right end cap, it is to be appreciated that the control system may also be connected with the left end cap in other arrangements of the invention.

f. Head Roller Support

Referring to FIG. 2, the cylindrical extension 62 is supported on a rotatable left end cap shaft 64 extending from the inner side 54 of the left end cap 48 and inserted into an aperture 66 located in the cylindrical extension. A fastener 71 passing into the extension aperture may be used to secure the cylindrical extension to the left end cap shaft 64. As such, the cylindrical extension 62 can freely rotate either clockwise or counterclockwise. A longitudinal inner groove 68 is located on the inner wall of the head roller 40 and extends the entire length of the head roller. Two longitudinal, circumferentially spaced ridges 70 on the exterior surface of the cylindrical extension 62 are adapted to be received in the longitudinal inner groove 68 on a left end portion of the head roller. As such, the cylindrical extension rotates along with the head roller.

As shown in FIG. 4, and discussed in more detail below, a circular recess 72 is located on the inner side of the right end cap 50 for receiving a portion of the control system. As illustrated in FIG. 3, a rotator spool 74, as will be described in more detail later and having rotation controlled by the control system 12, includes longitudinal fins 76 located on its exterior adapted to cooperatively engage the longitudinal inner groove at a right end portion of the head roller 40. As such, rotation of the rotator spool causes the head roller to rotate.

g. Control System Assembly Structure Overview

As can be understood from FIGS. 3 and 4, the control system 12 includes an input assembly 78, a transmission 80, and an output assembly 82 cooperatively engaging to convert linear movement of the pull cord 28 imparted by a user into rotational movement of the head roller 40 in the required direction to provide movement of the covering 16 in the desired direction and distance. The input assembly converts linear movement of the pull cord into rotational movement, which is imparted to the transmission. The input assembly also engages the transmission to effect the direction of rotational output from the transmission. The transmission, in turn, imparts rotational movement to the output assembly. The output assembly interfaces with the head roller to rotate the head roller in the direction dictated by the transmission and to provide the braking feature that holds the head roller in position. It is to be appreciated that rotational movement transferred between the input assembly, the transmission, and output assembly may be accomplished with any suitable motion transfer elements, such as gears and clutch plate couplings. It is to be appreciated that the components described herein may be constructed from various materials. For example, some embodiments of the present invention could utilize materials having the low flexible modulus characteristics of a thermoplastic elastomeric polymer while others a high-density polyethylene.

Figure 28:
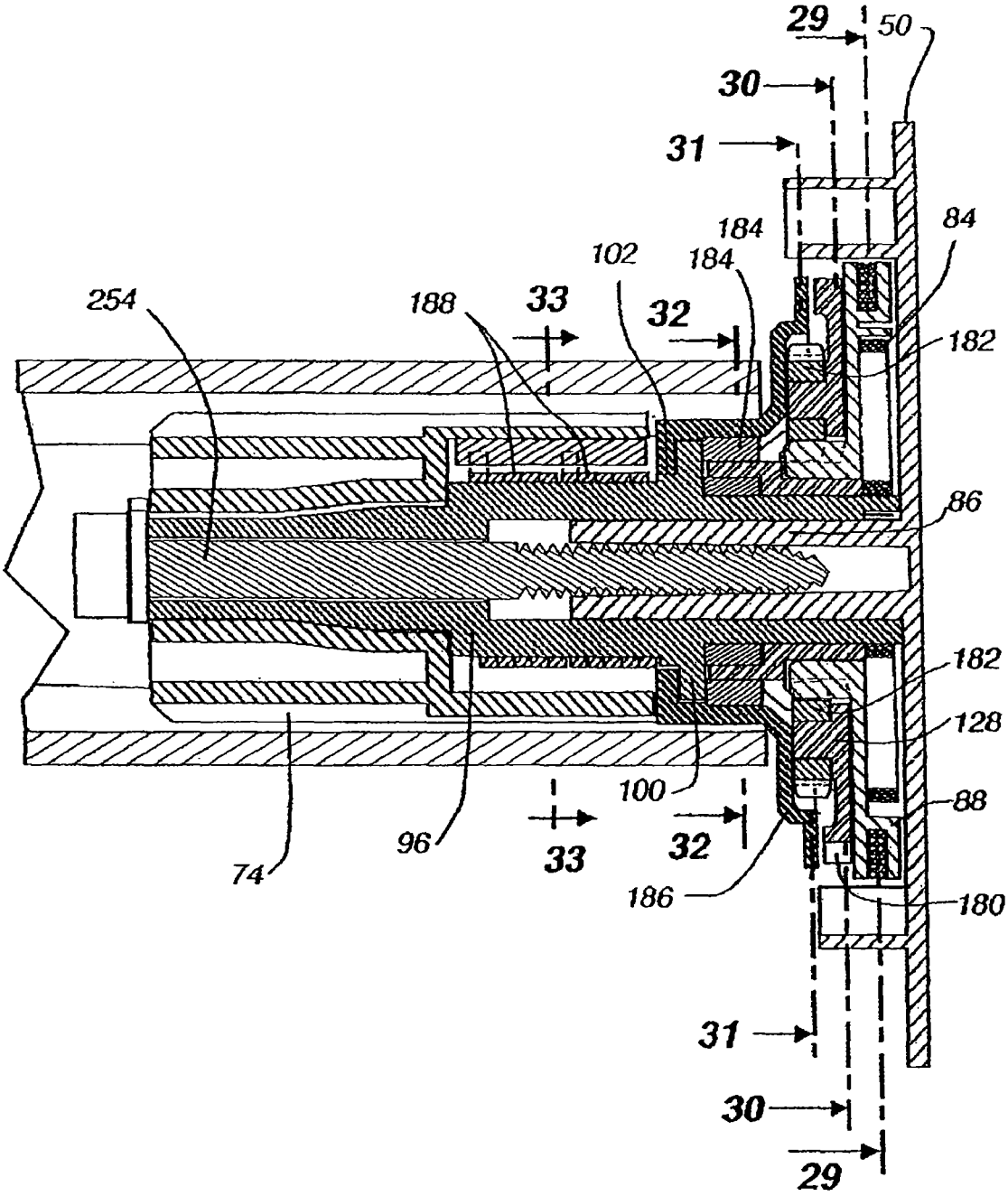
FIG. 28 is an enlarged section taken along line 28-28 of FIG. 27.
Figure 29:
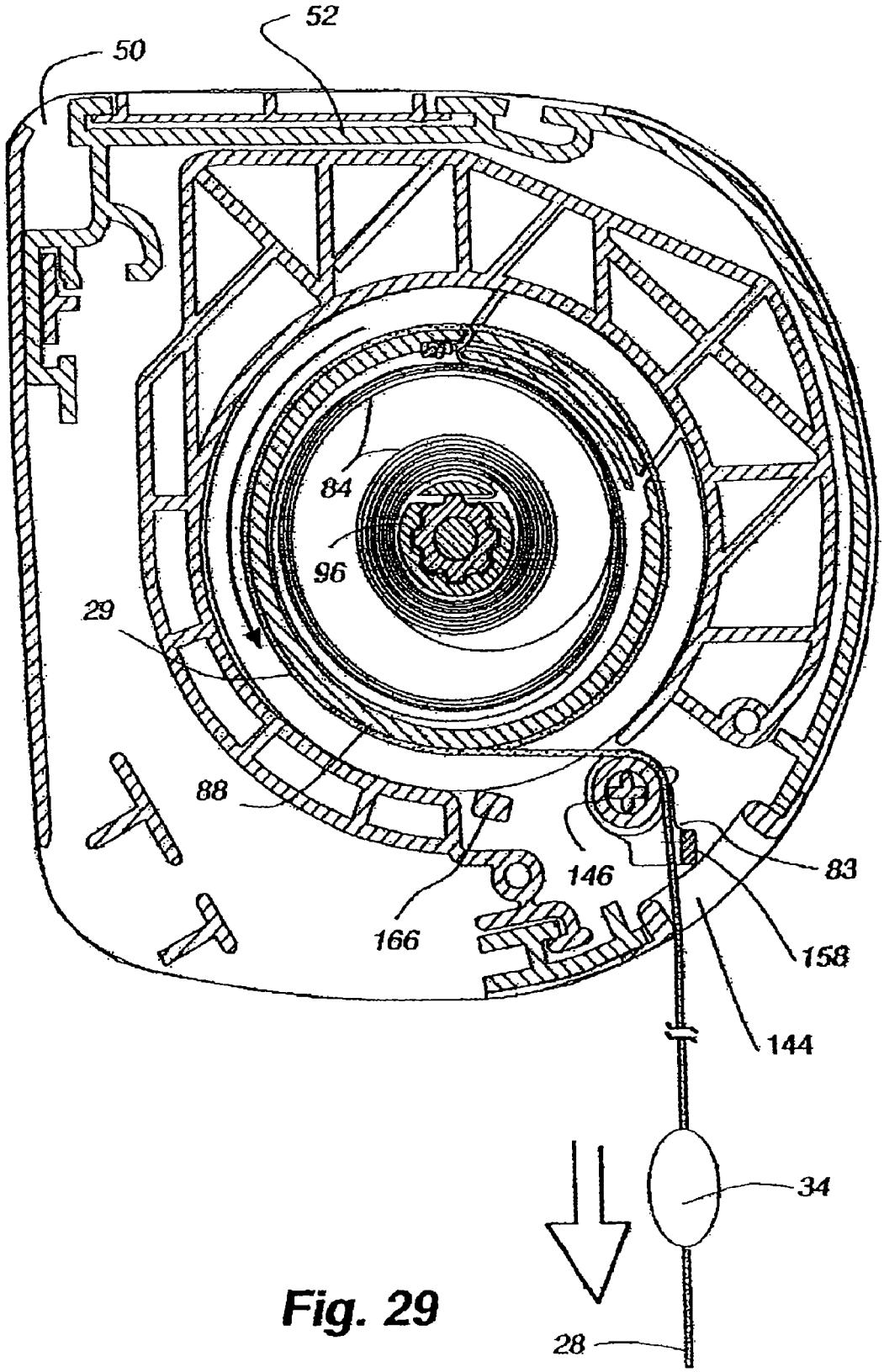
FIG. 29 is an enlarged section taken along line 29-29 of FIG. 28.
Figure 37:
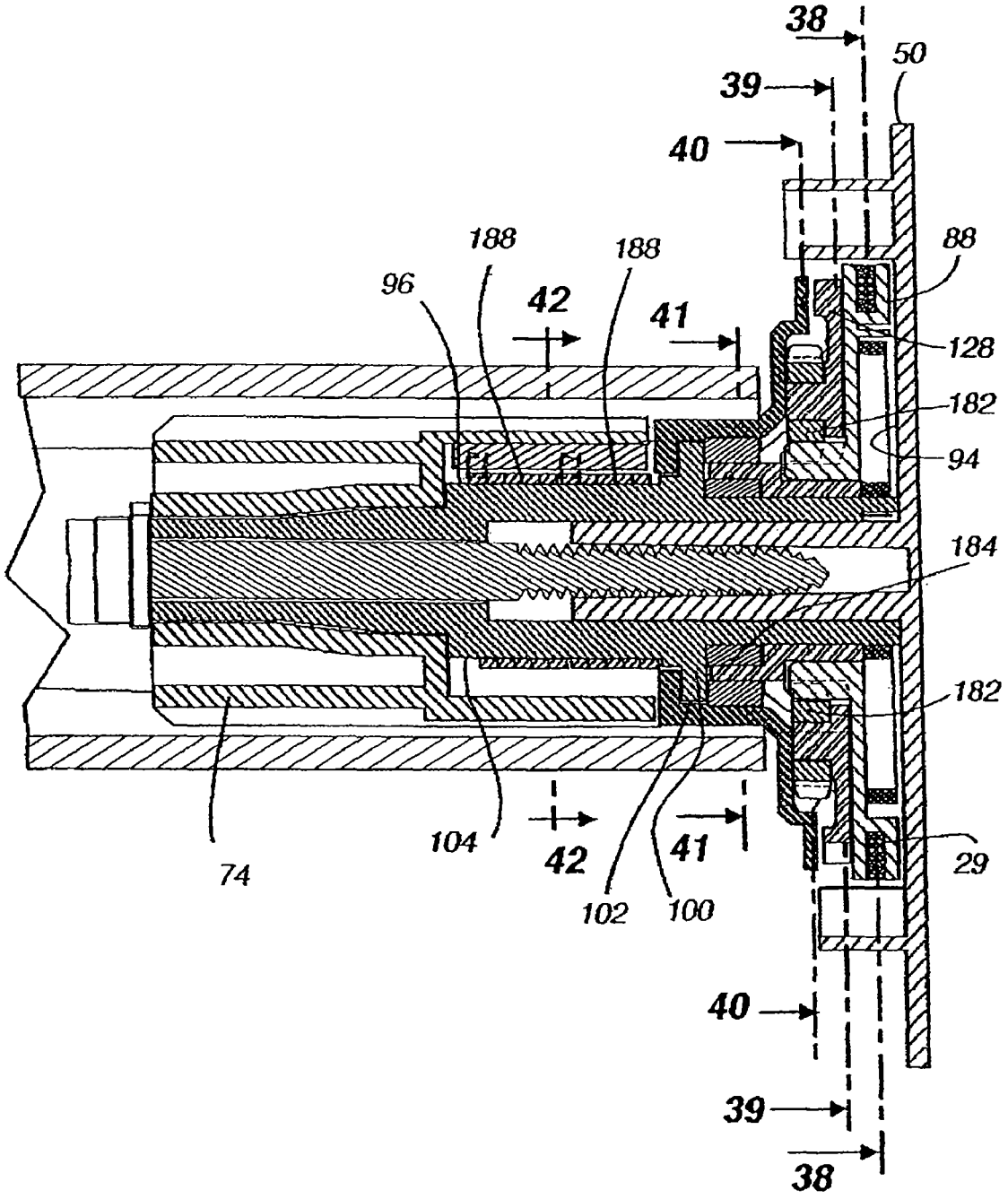
FIG. 37 is an enlarged section taken along line 37-37 of FIG. 36.
Figure 38:
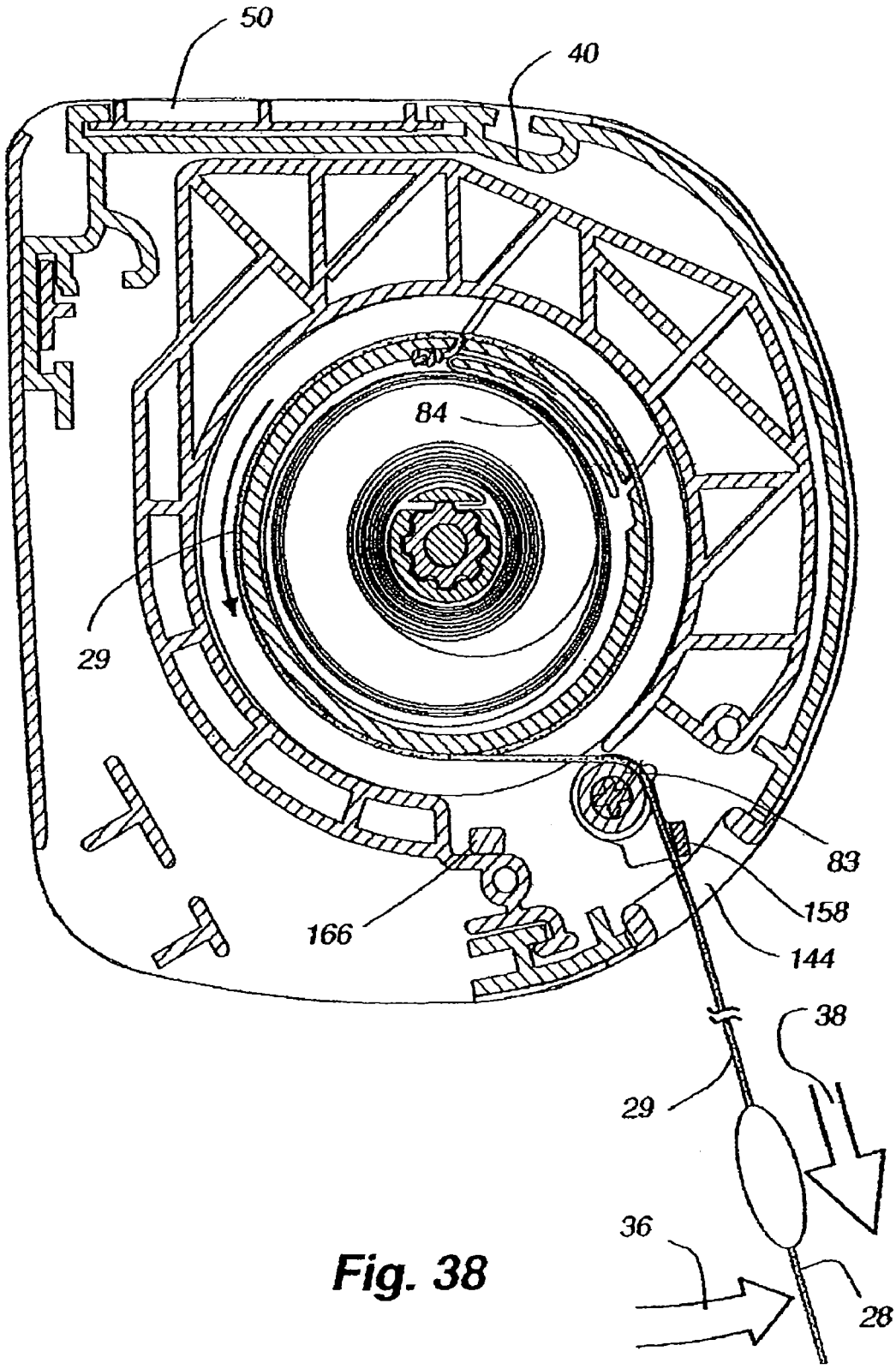
FIG. 38 is an enlarged section taken along line 38-38 of FIG. 37.
Figure 39:
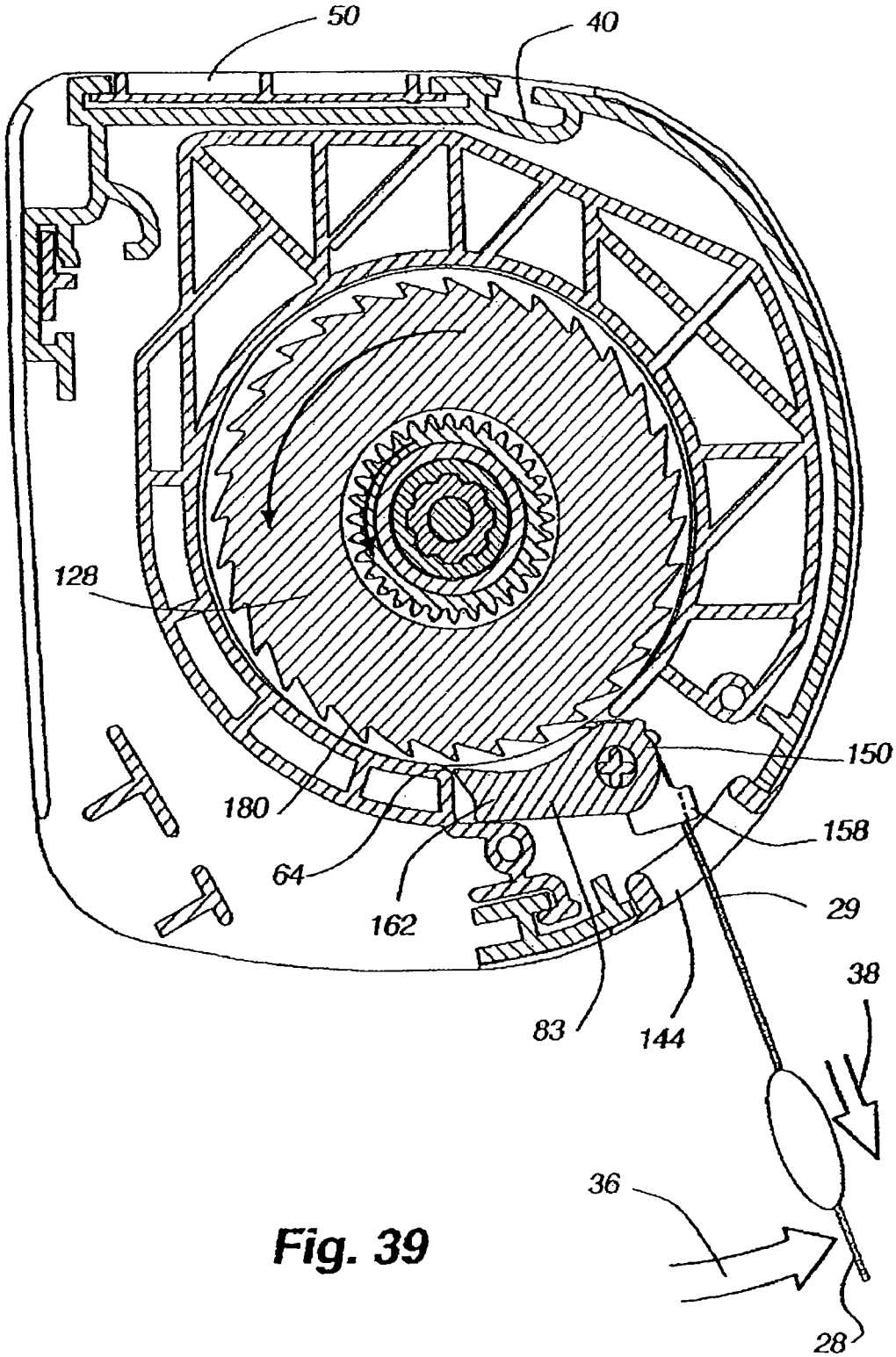
FIG. 39 is an enlarged section taken along line 39-39 of FIG. 37.
Figure 40:
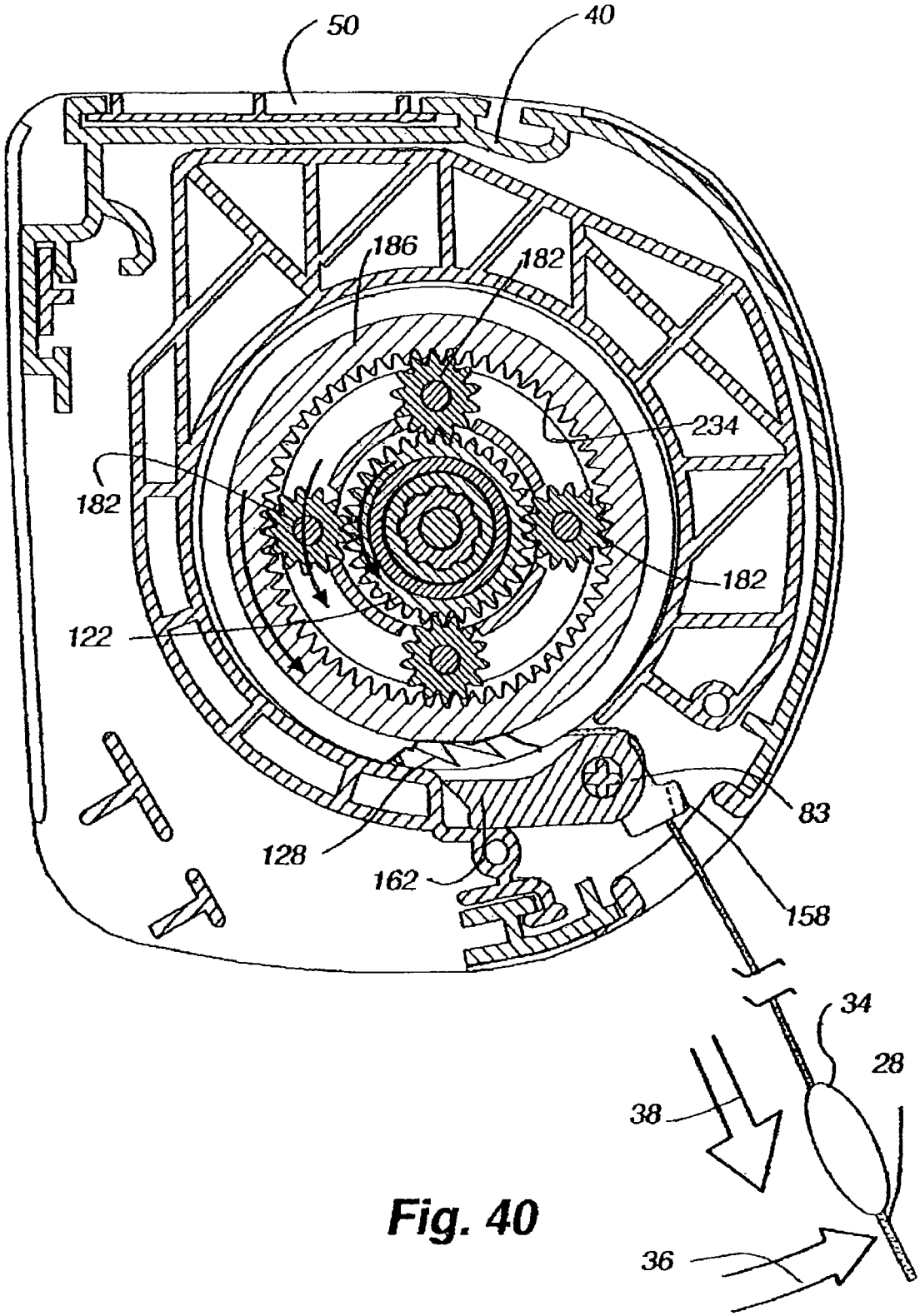
FIG. 40 is an enlarged section taken along line 40-40 of FIG. 37.

A detailed structural description of the input assembly 78 is provided below, followed by detailed descriptions of the transmission 80 and the output assembly 82. To assist in better understanding the structural details of the control system, reference is made throughout to the various figures depicting the control system in disassembled and assembled states. For instance, FIGS. 3 and 4 show exploded isometric views of the control system. FIG. 28 is a cross-sectional view of the assembled control system engaged to lower the window covering, taken along line 28-28 of FIG. 27. FIGS. 29-33 depict various cross sectional views taken along the length of the control system depicted in FIG. 28. FIG. 37 is a cross-sectional view of the assembled control system engaged to lower the covering, taken along line 37-37 in FIG. 36. FIGS. 38-42 depict various cross sectional views taken along the length of the control system depicted in FIG. 37. Descriptions of the rotations of various components of the control system (i.e. clockwise or counterclockwise) are always based on the reference point of looking toward the inner side of the right end cap.

h. Input Assembly Overview

The structure and operation of the input assembly 78 will now be discussed in detail. As shown in FIGS. 4-24, the input assembly includes the pull cord 28, the stopper or coupler 34, a shift arm 83, a clock spring 84, an axle 96, and a cord spool 88, all cooperatively engaging to convert linear movement of the pull cord into a rotational movement of the cord spool, which is imparted to the transmission 80. As discussed in more detail below, the pull cord extends upwardly from the stopper or coupler 34 and passes through the shift arm 83, from where it is wrapped around the cord spool 88. As a user pulls on the pull cord to move the covering 16 in the desired direction, the pull cord is unwound from the cord spool. As will be described in detail later, after the user releases tension from the pull cord, the clock spring, cord spool, and axle cooperatively engage to automatically wind the pull cord back onto the cord spool. The pull cord is automatically retracted to a point where the stopper or coupler 34 abuts the right end cap 50. Depending upon whether the user pulls the pull cord in the upward operating pull direction or the downward operating pull direction, the shift arm pivots to dictate its relationship with the transmission, which dictates the direction in which the head roller is rotated.

i. Tassel

As shown in FIG. 4, a tassel 90 may be connected with the pull cord 28 to allow a user to more easily grasp the pull cord when operating the control system. Various tassel configurations may be utilized. For example, the tassel shown in FIG. 4 has four sides converging upwardly toward each other and being connected with a flat top surface (not shown) having a tassel cord aperture 92 located therein. The pull cord extends from a first knot (not shown) located at a first or lower end of the pull cord and from the inside of the tassel 90 through the tassel cord aperture 92. The first knot is tied such that it is too large to pass through the tassel cord aperture. As such, the first knot engages the flat top surface from inside the tassel in order to connect the tassel with the pull cord. The tassel can be constructed from various types of materials, such as plastic or rubber. Depending on how much force the control system imparts on the pull cord when automatically retracting the operating cord, it may or may not be desirable to construct the tassel from a lightweight material. It is to be appreciated that the position of the tassel can be adjusted by simply moving the location of the first knot on the pull cord.

j. Releasable Clasp

As shown in FIG. 4, the stopper or coupler 34 is preferably in the form of a releasable clasp that can be releasably secured to the pull cord 28 and the operating cord 29 at any location along its length. The stopper 34 could be of the type disclosed in more detail in the aforementioned U.S. application Ser. No. 11/420,274.

k. Spool/Input Assembly

The right end cap 50 supports the various elements of the input assembly 78. As shown in FIG. 4, a circular recess 72 is defined by a partially circular wall 94 extending from the inner side of the right end cap 50. A first end cap shaft 85 and a second end cap shaft 146 are integrally connected with and extend perpendicularly from the inner side 72 of the right end cap 50. This shaft is fixed and do not rotate.

As discussed in more detail below, the assembly comprising the cord spool 88, the clock spring 84, and the axle 96, is rotatably supported by the first end cap shaft 85. The second end cap shaft 146 supports the pivot or shift arm 83 for pivotal movement between two operative positions dictating the direction of output for the control system.

Although a detailed structural description of the axle 96 follows, it should be noted the axle interfaces with the input assembly 78, the transmission 80 and the output assembly 82. As such, additional descriptions of the various functions performed by the axle will be described below separately as part of the detailed descriptions of the input assembly, the transmission, and the output assembly. It is to be appreciated, the axle can be made from various suitable materials. For example, the axle in a preferred embodiment of the present invention is made from a polycarbonate filled with a polymer such as PTFE or similar material.

As shown in FIG. 3, the axle 96 includes a plurality of outer surfaces defined along its length by varying diameters. Each outer surface is directed to a function more particularly described below. The axle as shown in FIG. 3 includes a first surface 98, a second surface 102, a flange 100, and a third surface 104. The first surface is separated from the second surface by the flange. The second surface is separated from the third surface by a shoulder 106.

As further seen in FIG. 3, a passage 108 is located through the center of the axle 96. The passage opens through a first end and a second end of the axle. As can be understood from FIG. 6, the passage is grooved at the first end 110 and is adapted at the second end 112 to receive a fastener. As appreciated by reference to FIG. 4, the outer surface of the first end cap shaft 85 is grooved to define a plurality of longitudinal ridges 114 extending radially from the circumference. The grooved surface of the first end cap shaft is adapted to cooperate with a correspondingly shaped grooved female opening in the first end of the axle. As such, the longitudinal ridges prevent the axle from rotating relative to the first end cap shaft.

l. Cord Spool & Clock Spring Connection

The structural and cooperative relationship between the cord spool 88, the clock spring 84, the axle 96, the shift arm 83, and the operating cord 29 of the input assembly 78 will now be described. As shown in FIG. 4, the cord spool is disc-shaped and includes a first side 116 and a second side 118. The first side 116 of the cord spool 88 includes a circular cavity 120 adapted to store the clock spring 84 and the second side 118 of the cord spool includes a sun gear 122 integrally attached thereto. As such, the cord spool and the sun gear rotate together. An opening 124 is located in the center of the cord spool and is adapted to accept a flange 126 integrally connected with a planet carrier 128, which is part of the transmission discussed below. When assembled, the cord spool is rotatably supported on the flange 126, which surrounds the first surface 98 of the axle.

Figure 16:
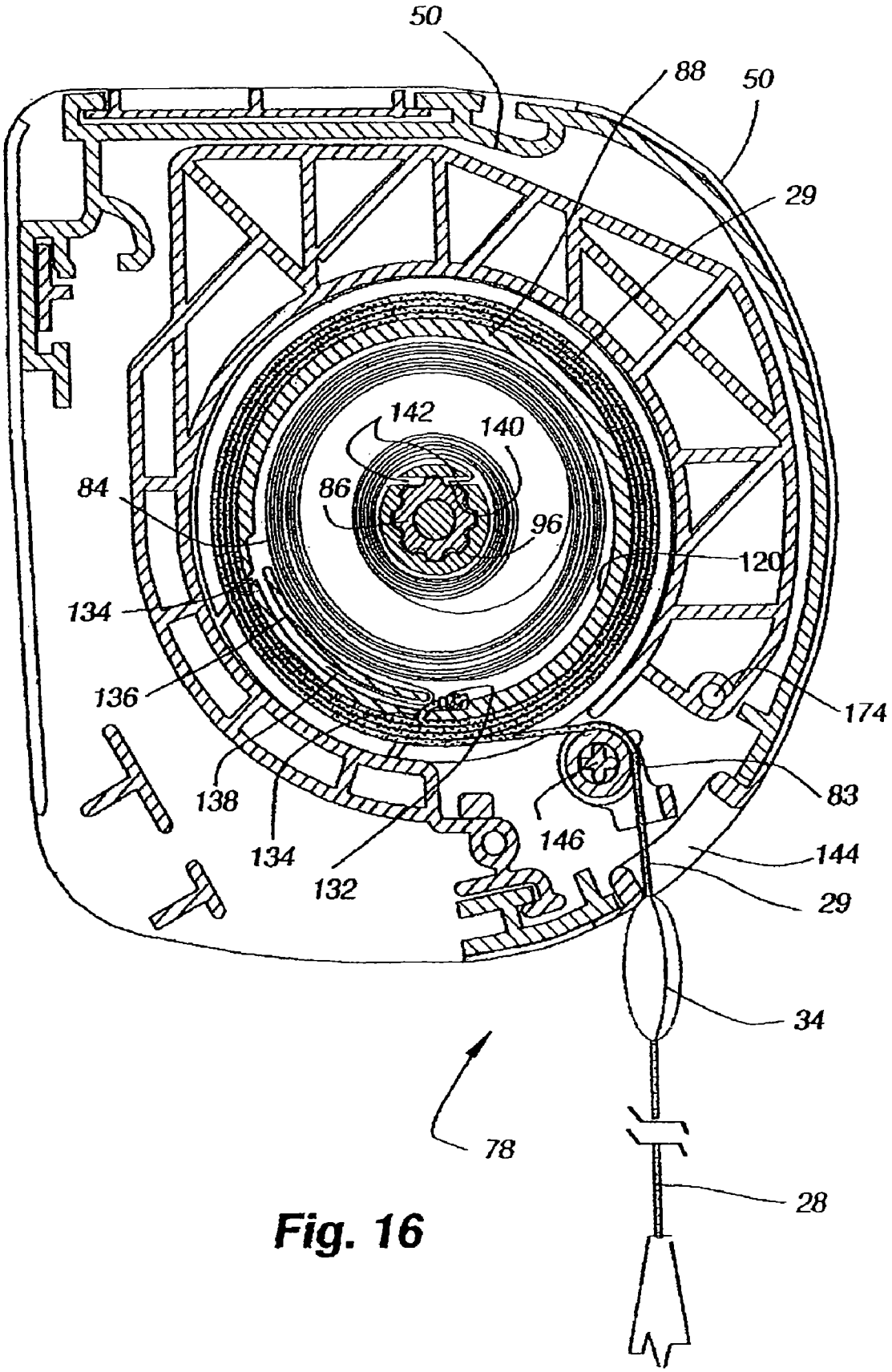
FIG. 16 is an enlarged section taken along line 16-16 of FIG. 15.

As shown in FIG. 4, the cord spool includes a groove 130 in its outer circumference adapted to receive the operating cord 29 wound thereupon. As seen in FIG. 16 and discussed in more detail below, the operating cord is wound clockwise (as viewed by looking toward the inner side of the right end cap) into the groove of the cord spool 88. As such, when the operating cord is unwound from the cord spool (i.e. when a user pulls on the pull cord), the cord spool rotates counterclockwise.

As seen in FIG. 16, a second knot 132 tied in a second end of the operating cord is located in the circular cavity 120. The operating cord 29 extends from the second knot and passes through a cord notch 134 and into the groove 130. The second knot prevents the operating cord from slipping through the cord notch, thus connecting the second end of the operating cord to the cord spool 88.

As shown in FIG. 15, the clock spring 84 is stored inside the circular cavity 120 of the cord spool 88. The clock spring functions to automatically retracted the operating cord 29 onto the cord spool when tension is released from the pull cord 28. The clock spring includes a first tang 138 located in the outer winding of the clock spring and a second tang 140 located in the inner winding of the clock spring. The first tang engages a first clock spring groove 130 located on the cord spool to connect the clock spring with the cord spool 88. The second tang 140 engages a second clock spring recess 142 on the first surface 98 of the axle 96 to connect the clock spring with the axle.

When a user pulls on the pull cord 28, which in turn unwinds the operating cord 29 from the cord spool 88, the cord spool rotates counterclockwise. Because the clock spring is fixed at the second tang 140 by the axle 96, the clock spring 84 retracts from an expanded state as the cord spool rotates counterclockwise. As such, rotation of the cord spool coils the clock spring to the extent the operating cord is wound thereupon. When tension is released from the pull cord and operating cord, the cord spool is rotated clockwise by the expanding clock spring to rewind the operating cord back onto the spool. As can be understood by reference to FIGS. 4 and 15, when the control system is assembled with its components, the axle is inserted into an opening 124 of the cord spool and wound slightly to place a preload on the clock spring 84. This preload on the clock spring assures that some tension is always maintained on the operating cord 29 when the system is not in use.

m. Operating Cord Path from Spool to Clasp

Figure 6:
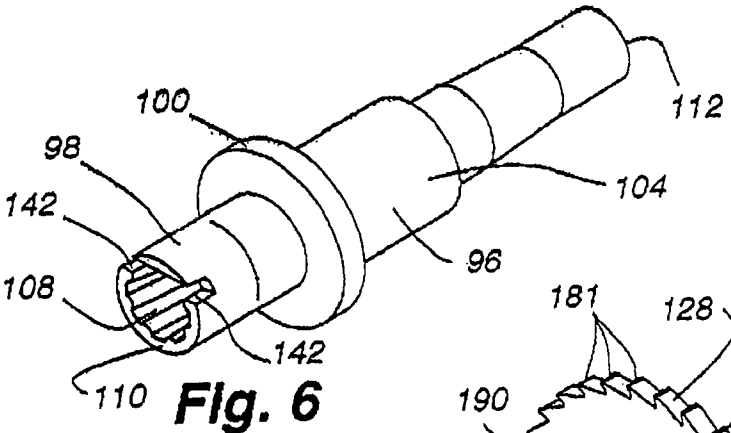
FIG. 6 is an isometric of an axle component of the control system.

As best appreciated by reference to FIGS. 6 and 16, the operating cord 29 passes from the cord spool 88 to wrap clockwise partially around the shift arm 83. From the shift arm, the operating cord exits the head rail through an opening 144 provided in the right end cap 50.

The shift arm 83 is pivotally supported on the second end cap shaft 146 for pivotal movement between two operative positions to be described hereafter with the second end cap shaft serving as a bearing for the shift arm. As mentioned previously, the pivotal position of the shift arm determines whether the shift arm engages the transmission 80, which in turn, dictates the direction in which the head roller 40 is rotated.

n. Shift Arm

As shown in FIGS. 4, 10-12, 16-18, and 22-24, the shift arm 83 includes a main body 150 and a cover plate 148. The main body has, as best appreciated by reference to FIGS. 10 and 11, a generally cylindrical portion with an axial passage 152 therethrough for pivotal receipt on the second end cap shaft 146 and a partial circumferential groove 154 formed in its surface which underlies a pair of offset guide fingers 156 defining a passage 57 therebetween for the operating cord 29. The operating cord slidably but frictionally engages the guide fingers 156. A stirrup 158 or trigger finger is formed on the cylindrical body 150 defining a generally vertically extending passage 160 therethrough that cooperates with the circumferential groove 154 so the cord can pass through the passage in the stirrup with the stirrup functioning as a trigger arm as will be more apparent hereafter. Extending in the opposite direction from the stirrup on the main body is a pawl arm 162 having a pawl tooth 164 defined along its upper edge and a lateral peg 166 along a bottom edge 168. The entire main body of the shift arm 83 is a single piece and therefore integrated for unitary movement.

Figure 10:
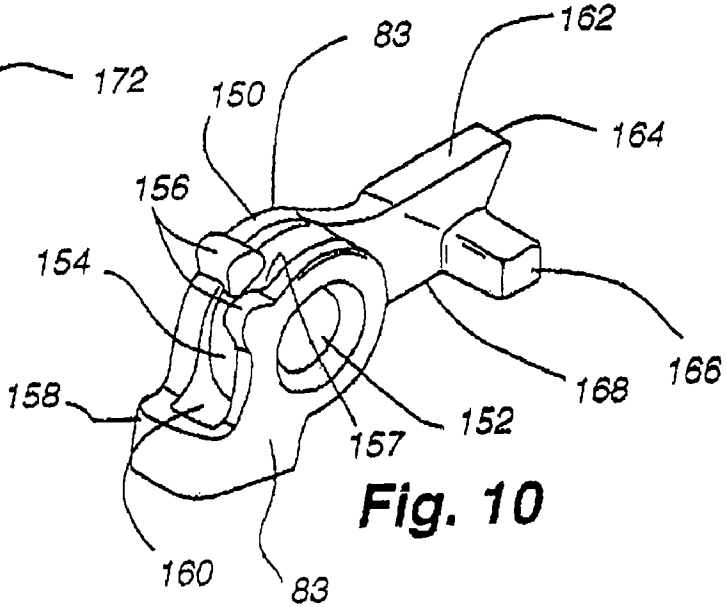
FIG. 10 is an isometric looking downwardly at one end of the pivot arm component of the control system.
Figure 11:
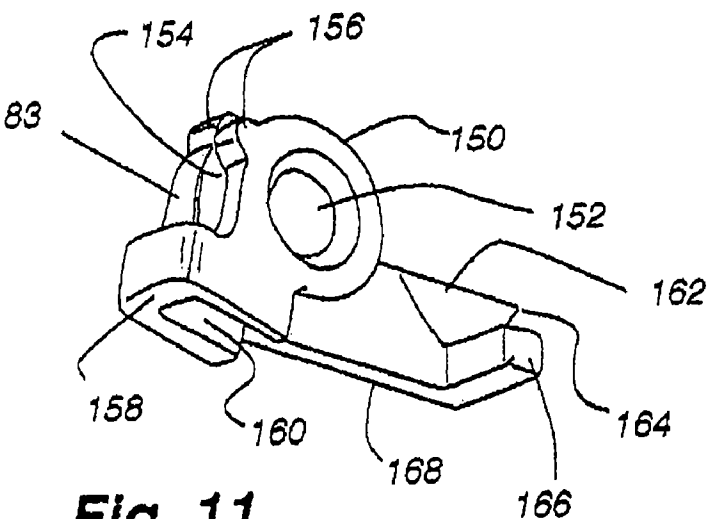
FIG. 11 is an isometric looking upwardly at the same end of the pivot arm as shown in FIG. 10.
Figure 44:
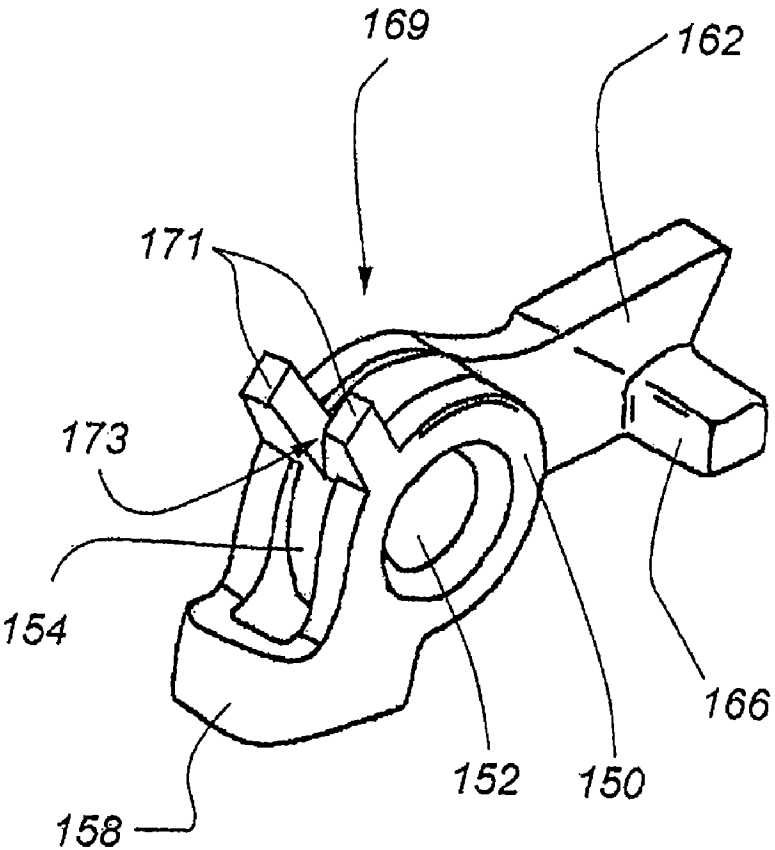
FIG. 44 is an isometric similar to FIG. 43 looking downwardly on the alternative shift arm.
Figure 43:
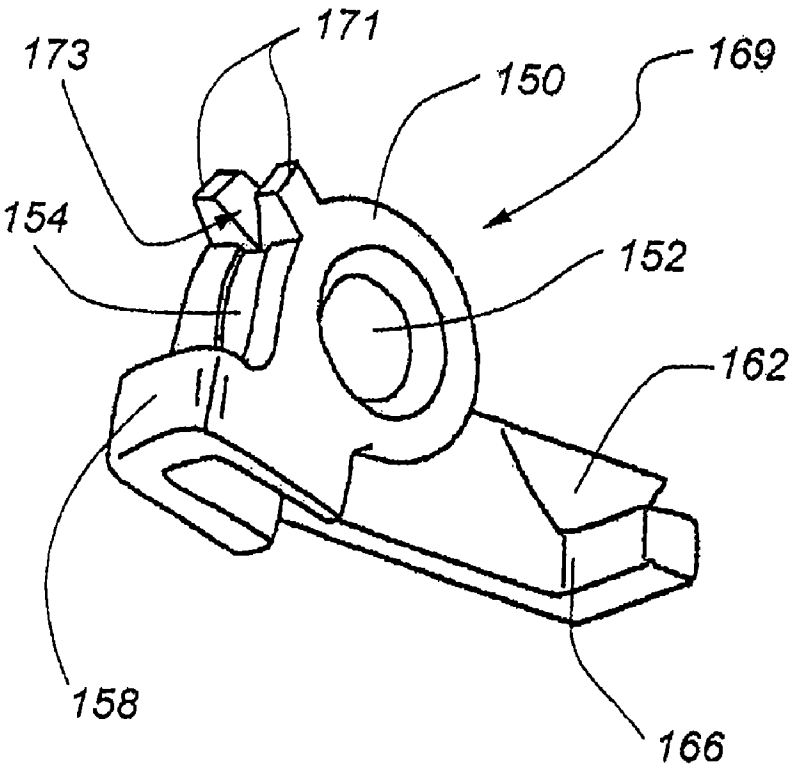
FIG. 43 is an isometric looking up from the bottom of an alternative shift arm to that shown in FIGS. 10 and 11.

An alternative embodiment of the shift arm 169 is shown in FIGS. 43 and 44 with this embodiment being substantially similar to that illustrated in FIGS. 10 and 11 with like parts having been given like reference numerals. The only difference in the shift arm in FIGS. 43 and 44 resides in the fact that it does not include offset guide fingers 156 as in the embodiment in FIGS. 10 and 11, but rather has aligned guide fingers 171, which are of generally wedge shape so as to define a V-shaped channel 173 therebetween. The V-shaped channel has been found to desirably frictionally engage the operating cord as an alternative to the offset fingers 156 of the shift arm of FIGS. 10 and 11, which define a serpentine passage therebetween.

The cover plate 148 is arcuate in configuration to conform with the curvature of the end cap 50 and has a central recess 170 therein for receipt of the end of the second end cap shaft 146, which of course extends parallel with the roller 40. The cover plate also has a pair of protruding fingers 172 which are adapted to be frictionally received in sockets 174 provided in the right end cap so the cover plate can be releasably held in place and protect and overlie the main body 82 for its dependable operation. As possibly best appreciated by reference to FIG. 17, ribbing 178 is provided in the right end cap 50 so as to define a pocket 176 into which the pawl arm 162 protrudes with the pocket having an outer wall adapted to engage the pawl arm in a neutral or downward operating pull direction position of the shift arm. It will be appreciated in the neutral position, the pawl 164 is disengaged but pivotal movement of the shift arm in a clockwise direction raises the pawl into operative engagement with a ratchet wheel 180 in the transmission to be described hereafter.

Figure 17:
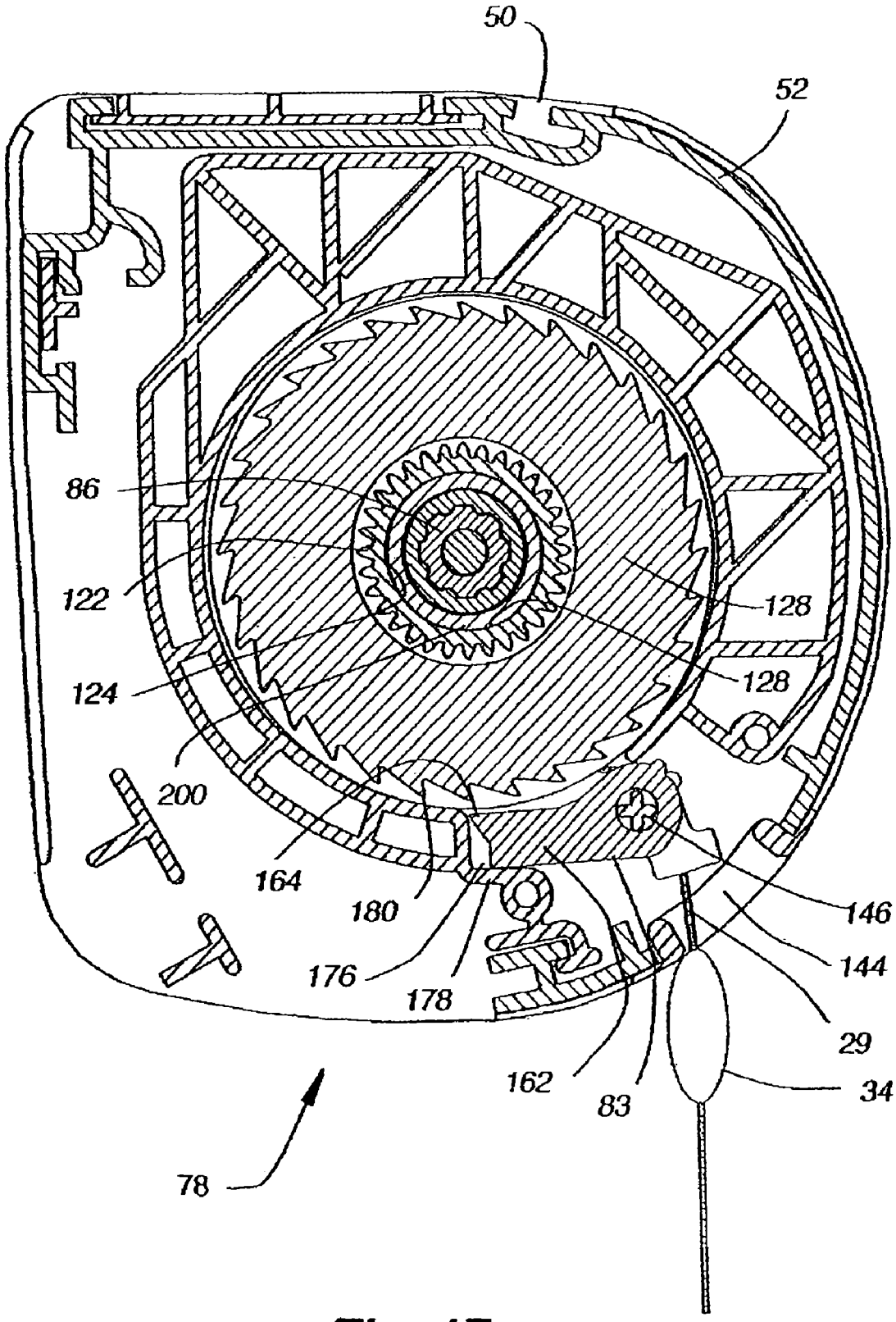
FIG. 17 is an enlarged section taken along line 17-17 of FIG. 15.
Figure 18:
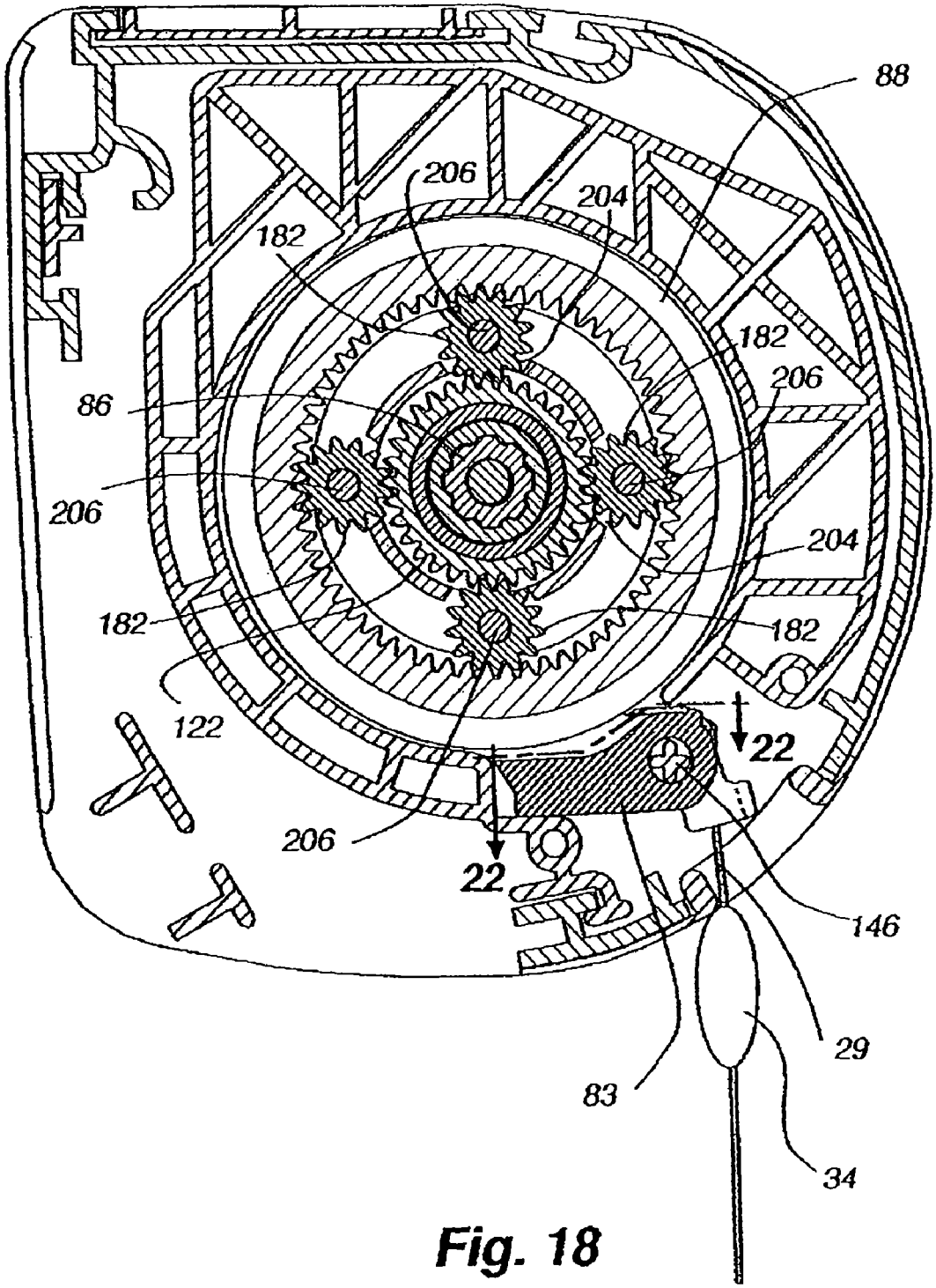
FIG. 18 is an enlarged section taken along line 18-18 of FIG. 15.

As is possibly best appreciated by reference to FIG. 16 and 17, the shift arm 83 is pivoted between its two operative positions about the second end cap shaft 146 and therefore in a plane perpendicular to the fabric by movement of the control cord 29 so if the control cord is simply pulled straight downwardly 32 as shown in FIG. 25, the friction of the cord passing across the circumferential groove 154 in the main body 150 of the shift arm 83 will cause the pawl arm 162 to pivot clockwise and engage the ratchet wheel 180. On the other hand, if the control cord is pulled toward the operator in a downward direction 38 and plane substantially perpendicular to the fabric, the cord 29 will engage the stirrup 158 thereby pivoting the pawl arm 162 in a counterclockwise direction and removing the pawl tooth 164 from the ratchet wheel 180. The above is accommodated by the shift arm being mounted for pivotal movement about an axis that runs parallel with the roller 40 and the length of the head rail 52.

o. Shift Arm Operation

To begin an operational sequence, a pull force upon the operating cord 29 causes the shift arm 83 to pivot but the direction of pivot depends upon whether or not the operating cord is pulled straight downwardly as illustrated in FIG. 25 or downwardly and toward the operator, i.e., away from the architectural opening in which the covering 16 is mounted as shown in FIG. 34. As mentioned previously, when a user pulls downwardly 32 on the pull cord 28 in either a straight down or downwardly and outwardly 36 direction, the operating cord is unwound from the cord spool which turns the cord spool in a counterclockwise direction. The operating cord feeds off the cord spool 88 to pass across the circumferential surface of the main body of the shift arm 83.

When the pull cord is pulled straight downwardly, as in FIG. 25, the friction of the cord 29 passing across the top 158 of the shift arm and between the guide fingers 156 as seen possibly best in FIG. 16, causes the pawl arm 162 to pivot in a clockwise direction and into engagement with the ratchet wheel 180. Conversely, when the operating cord is pulled downwardly but outwardly so it engages the stirrup 158 which pivots the shift arm in a counterclockwise direction, the operating cord 29 is unwound from the spool with the pawl tooth 164 being disengaged from the ratchet wheel. This relationship between the operating cord and the shift arm is probably best appreciated by reference to FIGS. 38 and 39. The shift arm 83 is biased toward a neutral disengaged position of FIG. 18 by the clock spring 84 which biases the cord spool 88 in a clockwise direction. This pulls the operating cord 29 in a clockwise direction for wrapping on the cord spool. The frictional engagement of the operating cord with the guide fingers 156 causes the shift arm to pivot counter clockwise into the position of FIG. 18 and the ribbing 178 (see FIG. 17) limits the amount of counter clockwise movement.

p. Transmission Overview

The structure and operation of the transmission 80 will now be discussed in detail. As shown in FIGS. 3 and 4, the transmission includes a sun gear 122 integrally connected with the second side 118 of the cord spool 88, a planet carrier or ratchet wheel 180, four planet gears 182, a spider 184, and a ring gear 186 (see FIG. 3). These components all cooperatively engaging to convert rotational movement of the cord spool into rotational movement of the ring gear, which imparts rotational movement to the output assembly 82.

As discussed previously, a user pulling on the pull cord 28 causes the cord spool 88 to rotate counterclockwise. Because the sun gear 122 is integral with the cord spool, the sun gear also rotates in a counterclockwise direction.

Figure 30:
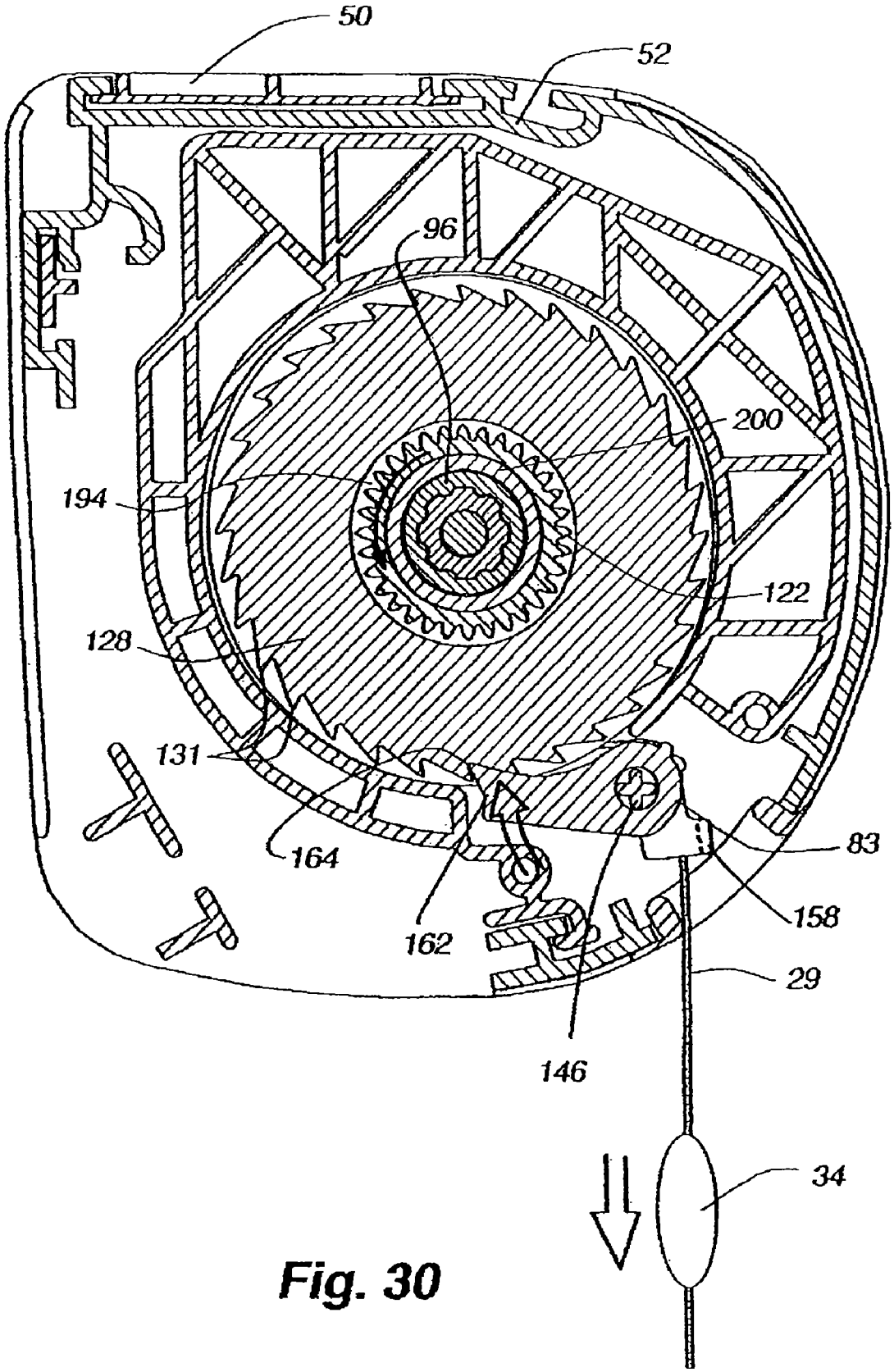
FIG. 30 is an enlarged section taken along line 30-30 of FIG. 28.
Figure 31:
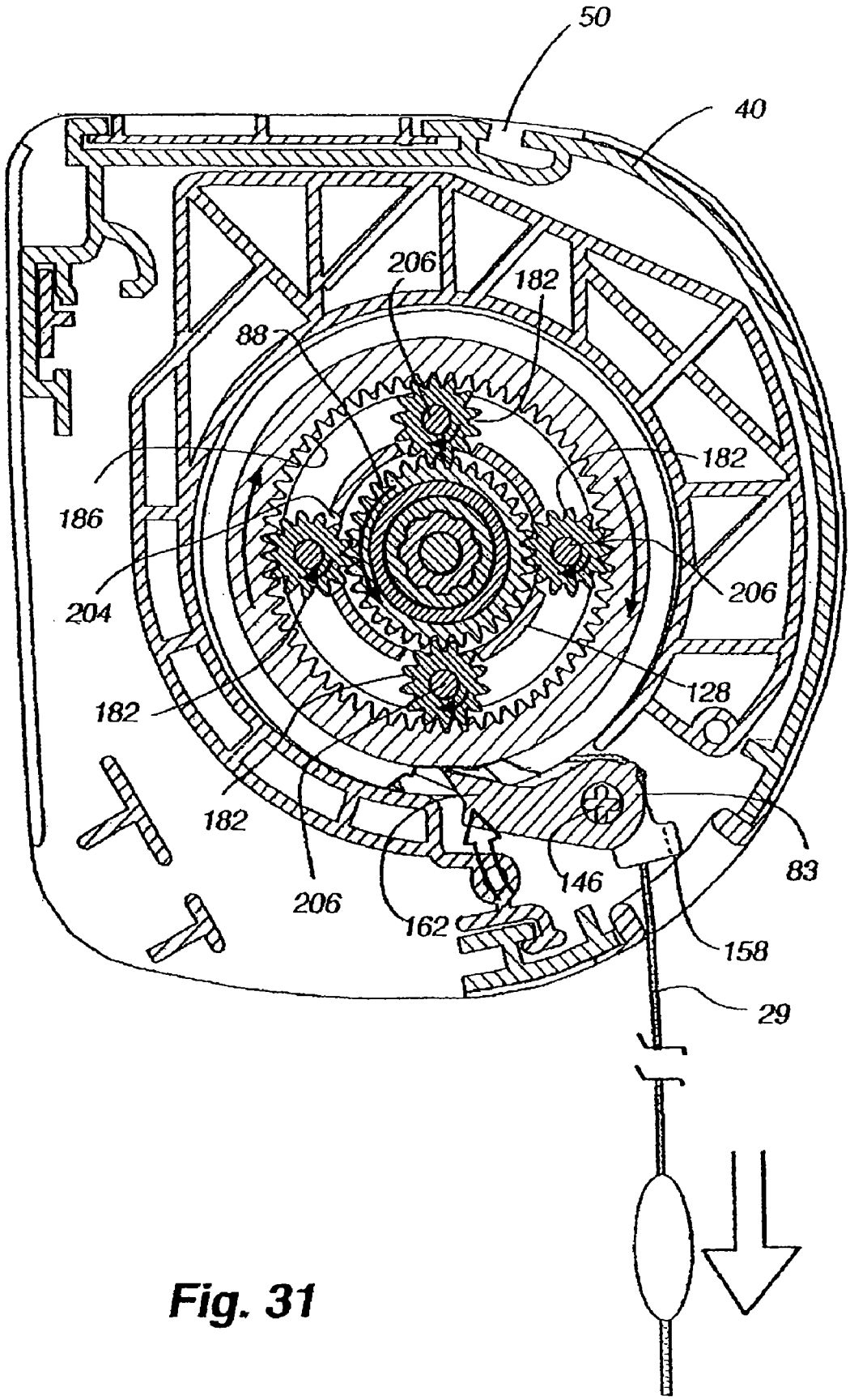
FIG. 31 is an enlarged section taken along line 31-31 of FIG. 28.

If the user pulls the pull cord 28 in the upward operating direction (see FIG. 25), the shift arm pivots until the pawl tooth 164 engages ratchet teeth 181 on the planet carrier 128, which prevents the planet carrier from rotating (see FIG. 30). Counterclockwise rotation of the sun gear causes clockwise rotation of the four planet gears 182 about their respective axes (see FIG. 31). The four planet gears in turn engage the ring gear 186 to turn the ring gear in a clockwise direction.

Alternatively, if the user pulls the pull cord 28 in the downward operating direction (see FIG. 34), the shift arm 83 does not pivot to engage the pawl tooth 164 with the planet carrier 128 (see FIG. 39), allowing the planet carrier to rotate. As such, counterclockwise rotation of the sun gear 122 initially causes clockwise rotation of the four planet gears 182 about their respective axes as the four planet gears orbit counterclockwise about the axis of the sun gear 122 (see FIG. 40) due to the planet carrier rotating counterclockwise as a result of frictional resistance between interfacing surfaces of the planet carrier and the cord spool. After the planet carrier has rotated counterclockwise for a brief period, the planet carrier engages the spider 184 to turn the spider in a counterclockwise direction, which engages the ring gear to turn in a counterclockwise direction (see FIG. 41). At this time, the four planet gears 182 cease to rotate about their respective axes and simply continue to orbit counterclockwise about the axis of the sun gear 122 as the planet carrier rotates counterclockwise (see FIG. 40). Adequate engagement of the planet carrier with the spider to facilitate the cord spool, planet carrier and ring gear turning counterclockwise as one integral unit is made possible by the resistance to motion of the ring gear 186 by frictional drag associated with the wrap springs 188.

As discussed in more detail below, the spider 184 acts as a part time one-way clutch activated by the planet carrier to rotate the ring gear. As such, when the spider is deactivated, the spider would not interfere with rotation of the ring gear in either the clockwise or counterclockwise directions.

q. Sun Gear, Planet Carrier & Planet Gears

As mentioned above and as shown in FIG. 4, the sun gear 122 is integrally connected with the second side of the cord spool 88 and is adapted to engage four planet gears 182 on the planet carrier. Although four planet gears are depicted and described with reference to the transmission, it is to be appreciated that the transmission can be configured to include more than or less than four planet gears. The planet carrier 128 or ratchet wheel 180 is disc-shaped and has a first side 190 and a second side 192 with a center circular opening 194 passing there through, as shown in FIG. 4. A series of ratchet teeth 181 are located on the periphery of the planet carrier. The ratchet teeth are adapted to engage with the pawl tooth 164 on the shift arm. The sun gear is adapted to be received in the center circular opening 194 of the planet carrier from the first side 190. The flange 198 inside the center circular opening includes an inner surface adapted to receive the first surface 98 of the axle 96 and includes an outside surface 200 to act as a bearing surface for the sun gear. The length of the flange, the width of the sun gear, and the depth of the center circular opening are substantially equal to allow the flange and the sun gear to fit together so as to enable the sun gear to engage the planet gears.

As shown in FIG. 4, the second side of the planet carrier 128 includes a circular shaped raised structure 202 adapted to accept the four planet gears 182. The raised structure has four sun gear openings 204 spaced at ninety-degree intervals there around. Planet gear axles 206 extending from the second side of the planet carrier and are radially positioned to correspond with the location of the sun gear openings 204 in the raised structure 202. The planet gears are configured with center holes 183 adapted to receive the planet gear axles. As such, when the planet gears are positioned on the planet carrier axles, the planet gears project geared surfaces into the sun gear openings 204. Moreover, upon inserting the sun gear into the center circular opening of the planet carrier, the sun gear 122 engages the planet gears 182. Therefore, rotation of the cord spool rotates the sun gear, which rotates the four planet gears.

r. Engagement of Planet Carrier and Spider

Figure 19:
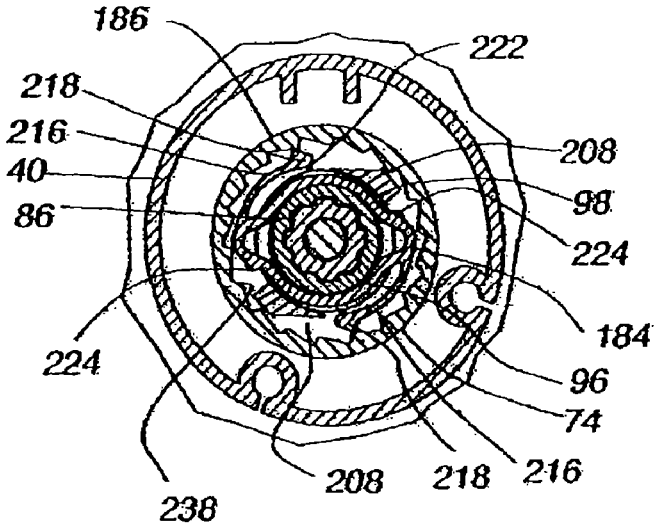
FIG. 19 is a section taken along line 19-19 of FIG. 15.
Figure 20:
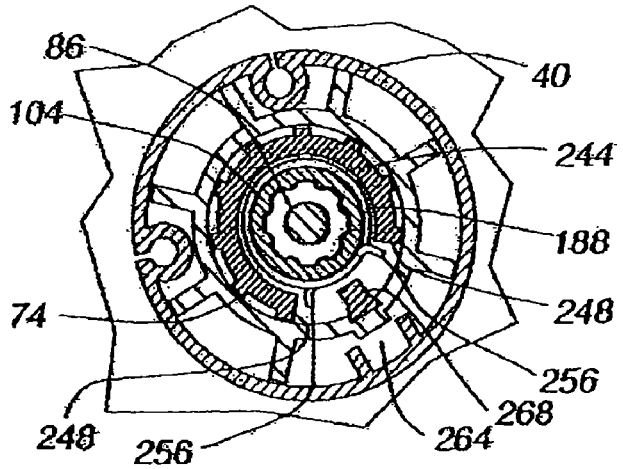
FIG. 20 is a section taken along line 20-20 of FIG. 15.
Figure 21:
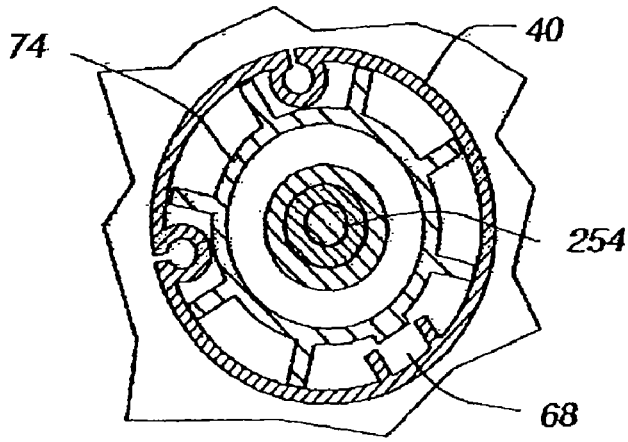
FIG. 21 is a section taken along line 21-21 of FIG. 15.
Figure 22:
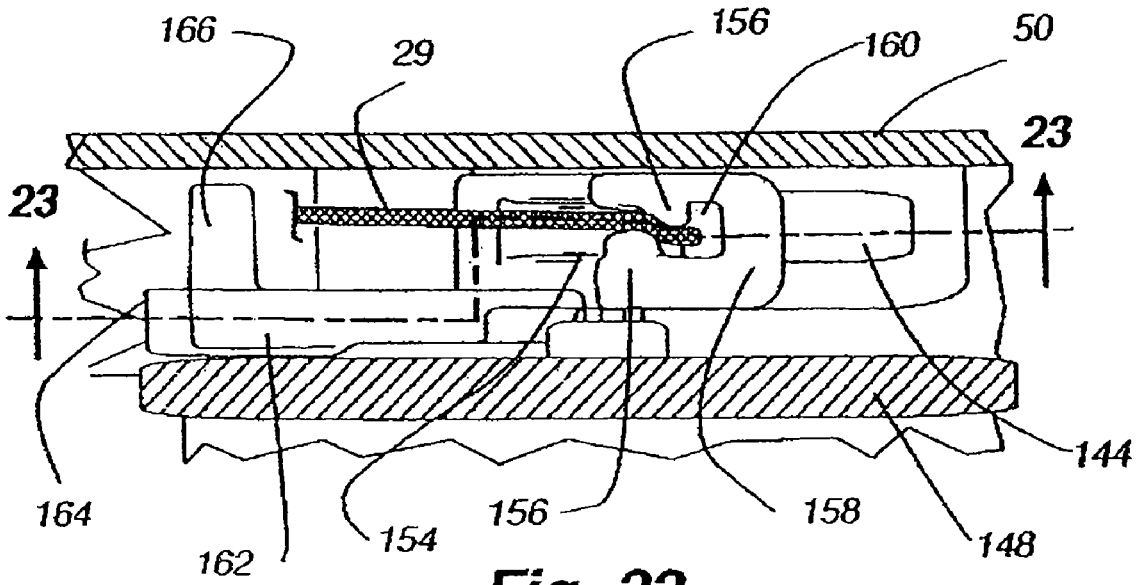
FIG. 22 is an enlarged fragmentary section taken along line 22-22 of FIG. 18.
Figure 23:
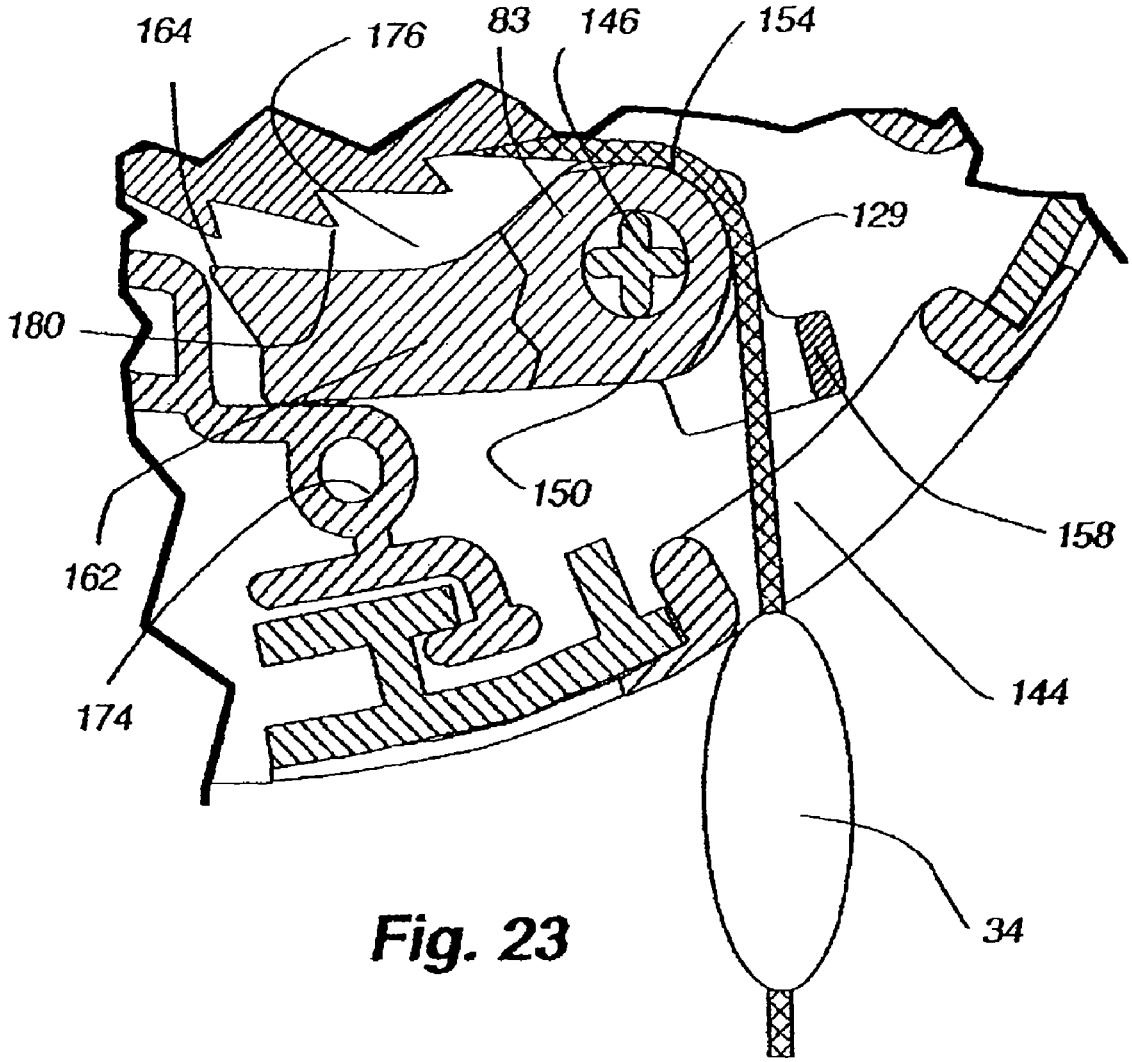
FIG. 23 is a fragmentary section taken along line 23-23 of FIG. 22.
Figure 24:
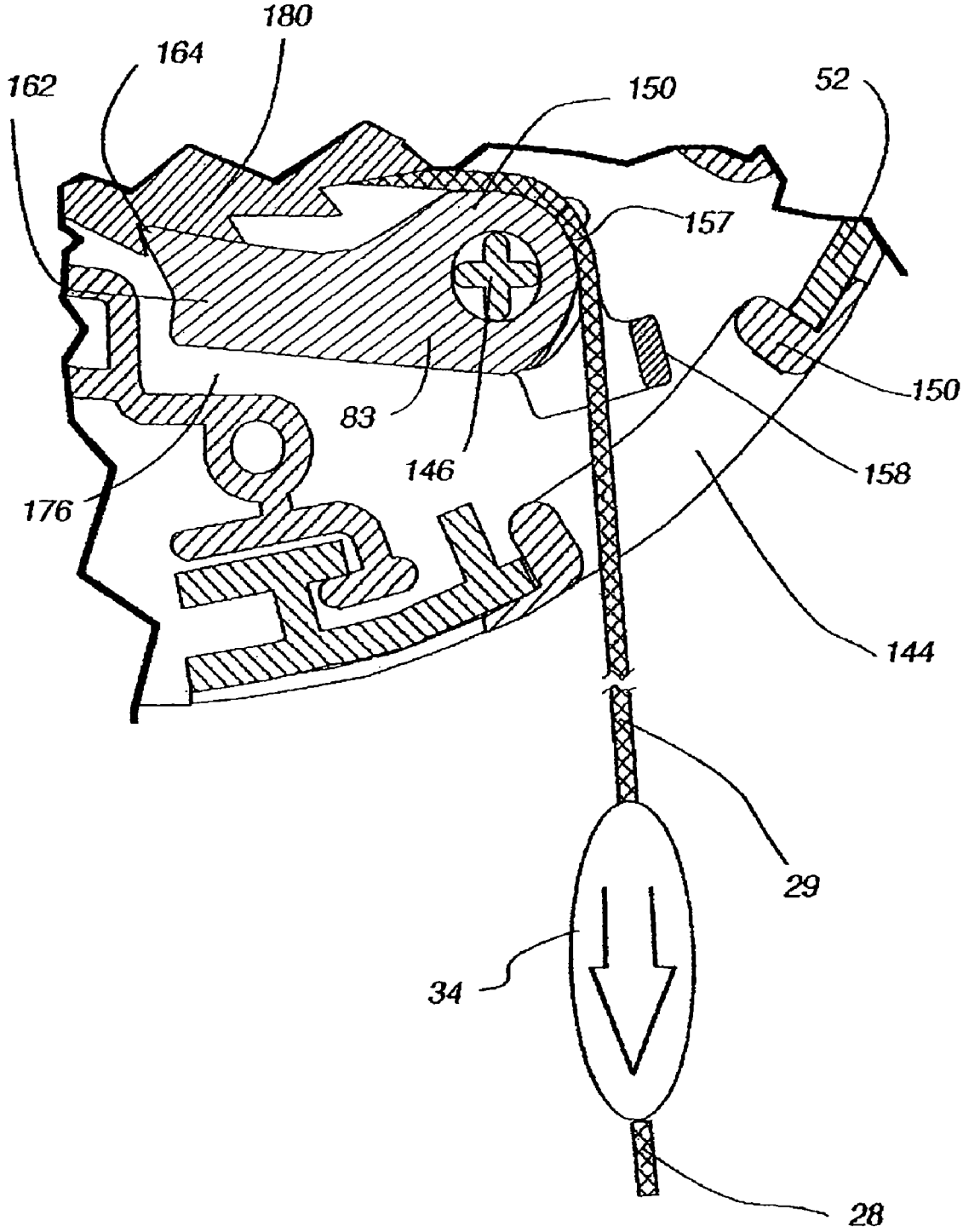
FIG. 24 is a section similar to FIG. 3 showing the control element having been pulled straight downwardly a short distance.

As shown in FIGS. 19 and 20, two actuator tabs 208 extend from the circular raised structure 202 on the planet carrier 128. The actuator tabs are trapezoidally shaped. The actuator tabs are adapted to engage the spider 184, seen independently in FIG. 5, upon rotation of the planet carrier. The spider includes a somewhat flexible and resilient body 210 generally oblong or "football" shape having an open center 212 with rounded ends 214. Arcuate legs 216 project from the rounded ends in opposite directions with respect to each other. The legs may also be flexible and resilient so as to be bendable outwardly or away from the body. Wedges 218 located at a distal end of each leg 216 are adapted to engage the small notches 222 on the actuator tabs and the ring gear upon counterclockwise rotation of the planet carrier, as discussed in more detail below. Opposite a point of attachment of each leg is a small stop 224 adapted to engage the actuator tabs 208 upon clockwise rotation of the planet carrier. It is to be appreciated the spider can be made from various suitable materials. For example, the spider in one embodiment of the present invention is made from a thermoplastic polyester elastomer, such as HYTREL® manufactured by DUPONT®. Other embodiments are made from creep resistant, low modulus, amorphous thermoplastics such as polycarbonate.

The open center 212 of the spider 184 is adapted to receive the first surface 98 of the axle 96. The engagement of the first surface of the axle and the open center of the spider is an interference fit. As such, the diameter of the open center of the spider is slightly smaller than the outside diameter of the first surface of the axle. In one embodiment of the present invention, the diameter of the open center of the spider is 0.016 inches smaller than the outer diameter of the first surface of the axle. The interaction of the spider material with the axle material along with the interference fit create some friction between the spider and the first surface of the axle, but the spider can move around the first surface without binding. The friction between the body 210 of the spider and the first surface of the axle enables engagement of the actuator tabs 208 with the spider upon rotation of the planet carrier 128 in a counterclockwise direction, and disengagement of the spider from the actuator tabs upon rotation of the planet carrier in a clockwise direction.

Figure 46:
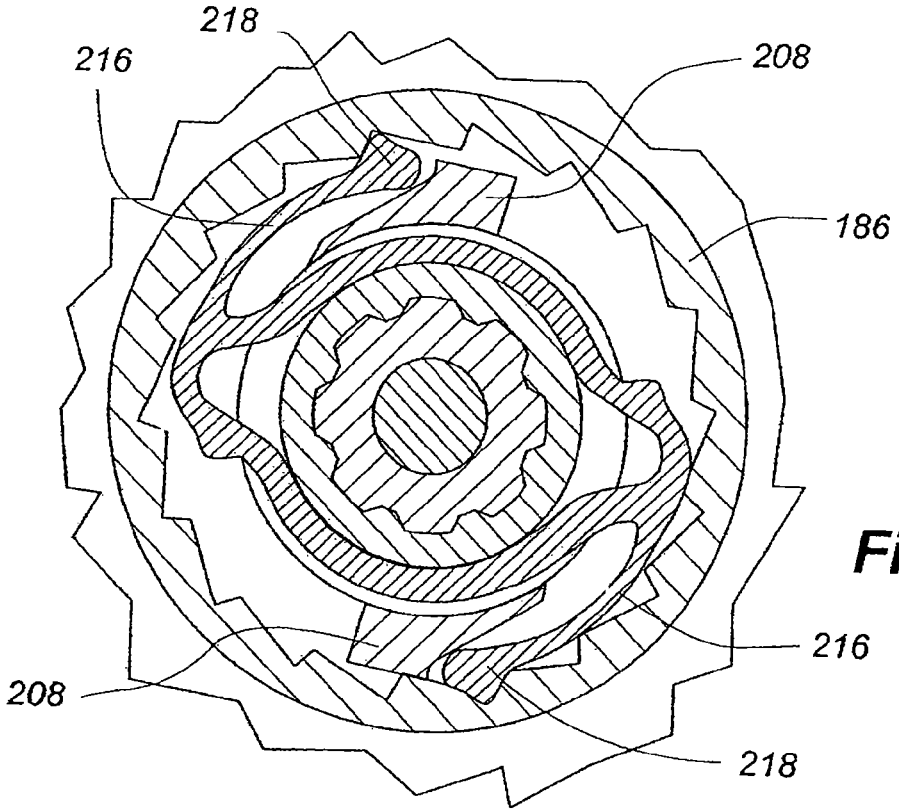
FIG. 46 is a section similar to FIG. 45 with the actuator tabs advanced still further in a counterclockwise direction.
Figure 45:
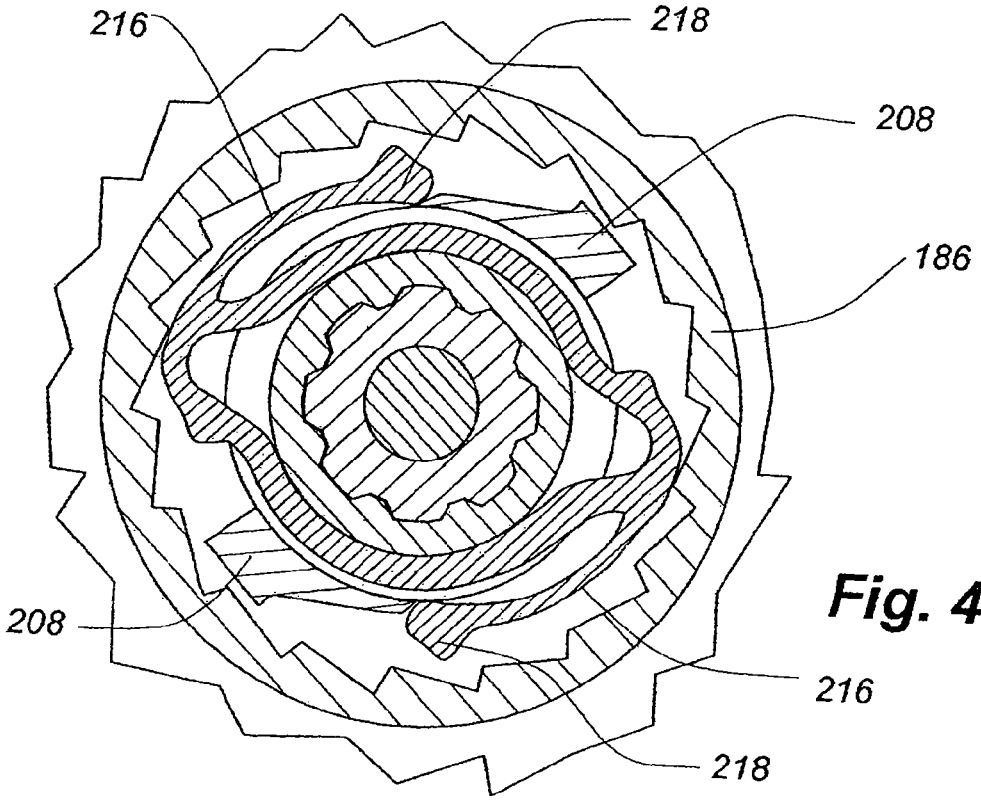
FIG. 45 is a section similar to FIG. 19 showing the actuator tabs advanced in a counterclockwise direction.

FIGS. 45 and 46 illustrate the relationship of the actuator tabs 208 to the spider 184 when the actuator tabs are moved in a counterclockwise direction relative to the spider. In FIG. 45 the leading edge of an actuator tab has engaged the notch 222 on an associated leg 216 of the spider with the actuator tab having advanced beneath the leg 216 in FIG. 46 so as to raise the wedge 218 into engagement with the ring gear 186.

Figure 32:
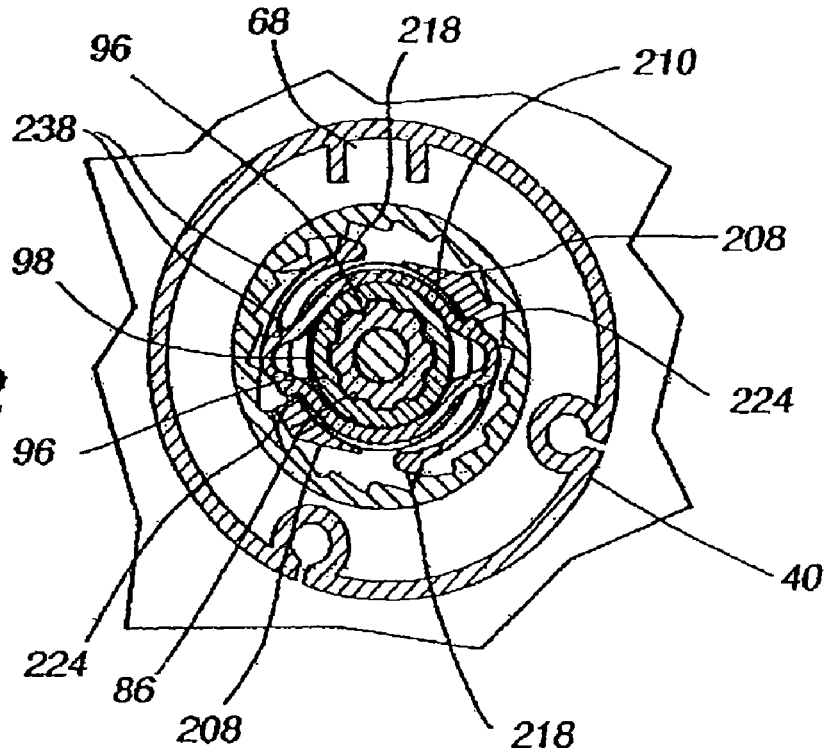
FIG. 32 is a section taken along line 32-32 of FIG. 28.
Figure 33:
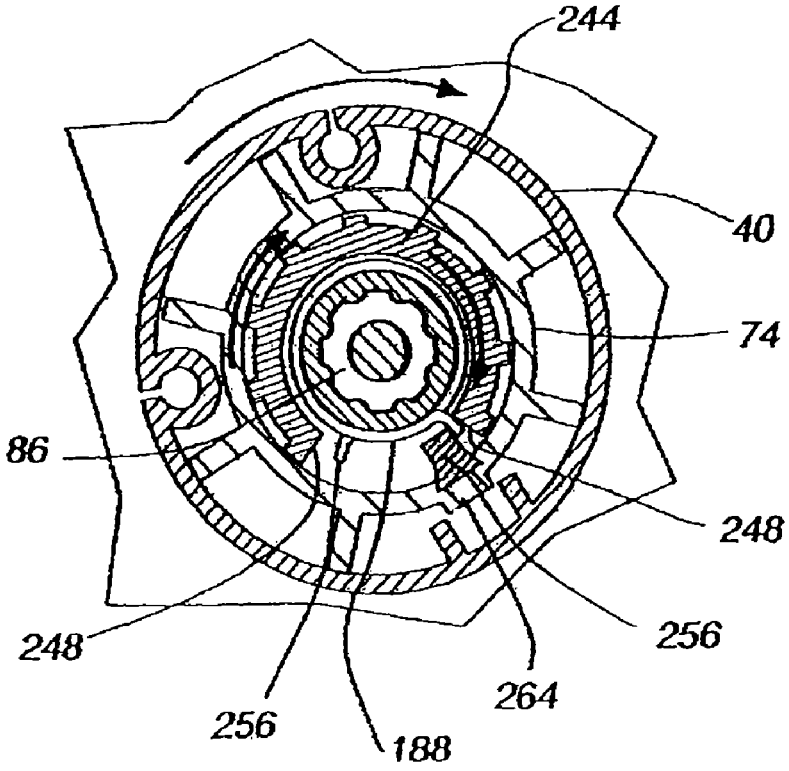
FIG. 33 is a section taken along line 33-33 of FIG. 28.
Figure 48:
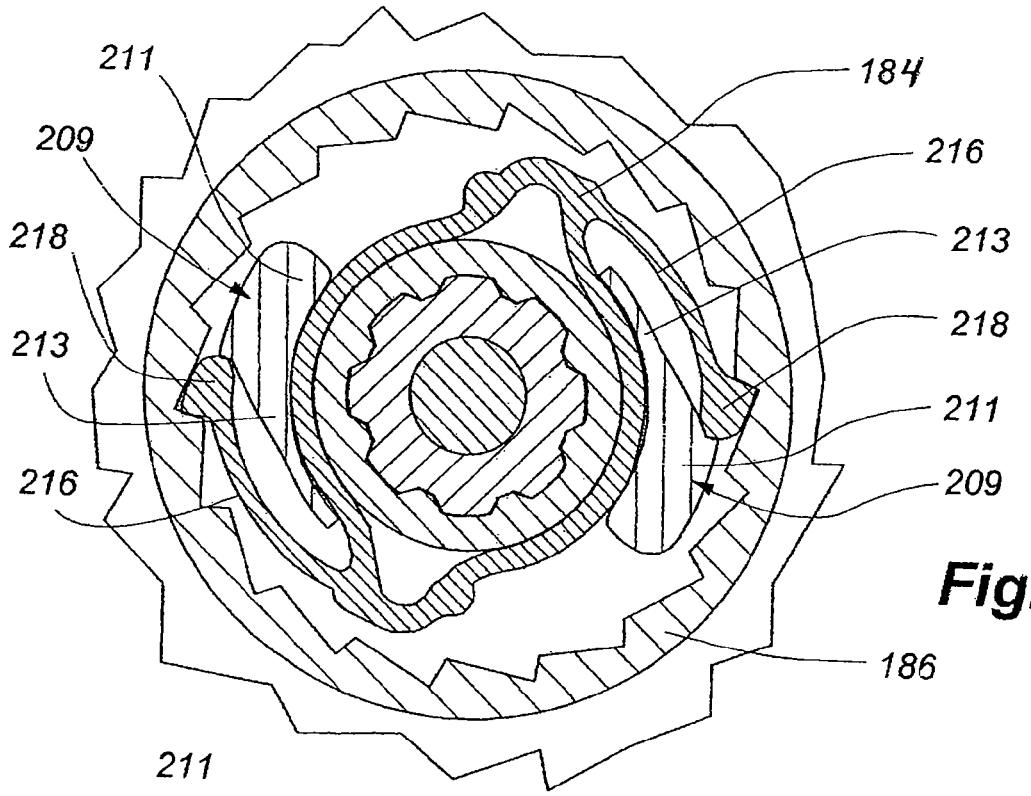
FIG. 48 is a section similar to FIG. 47 with the actuator tab advanced in a counterclockwise direction.
Figure 47:
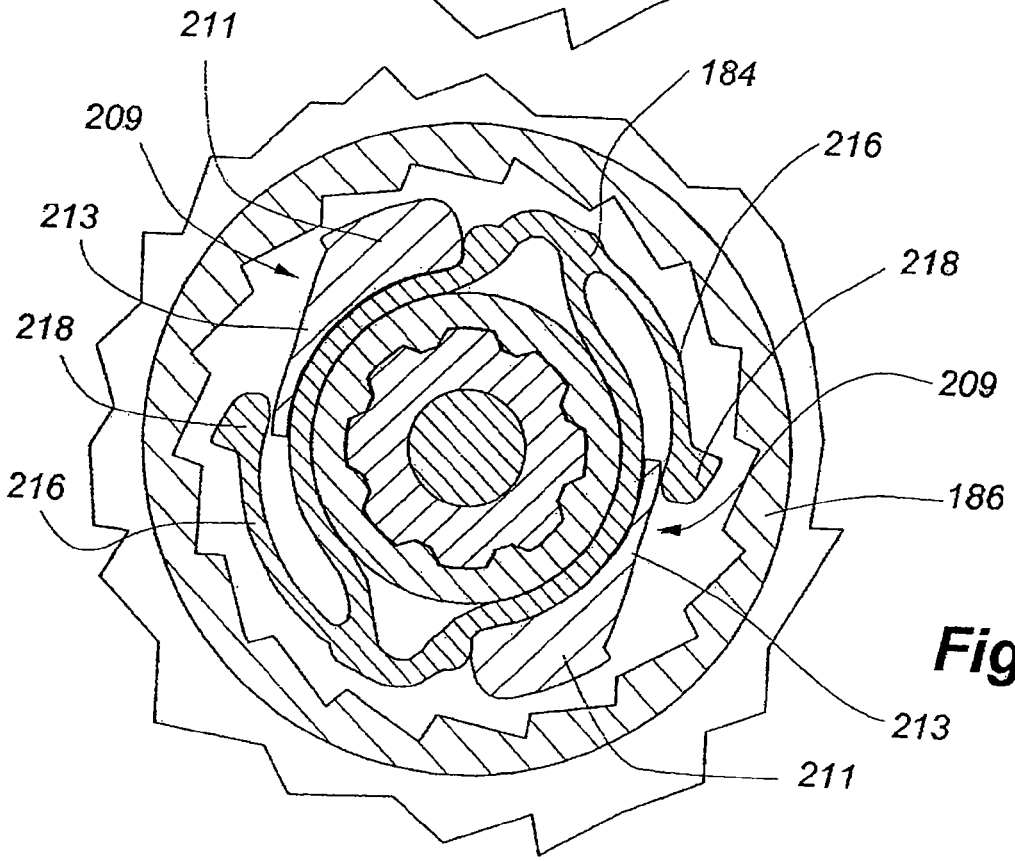
FIG. 47 is a section similar to FIG. 45 utilizing an alternative configuration of an actuator tab.

With reference to FIGS. 47 and 48, an alternative embodiment is illustrated wherein the actuator tabs 209 are configured differently from that illustrated in FIGS. 19 and 32 with the actuator tabs of the embodiment of FIGS. 47 and 48 having an enlarged trailing head 211 and a forwardly tapered leg 213 that is always positioned beneath an associated wedge 218 of the spider 184. For example, as illustrated in FIG. 47, the actuator tab 209 is withdrawn in a clockwise direction to a maximum extent with the tapered leg 213 still being positioned beneath an associated wedge 218. When the actuator tabs 209 are advanced in a counterclockwise direction to the position shown in FIG. 48, the tapered legs 213 cam the associated wedges 218 outwardly into engagement with the ring gear 186. The embodiment of FIGS. 47 and 48 provide for a smoother motion as the actuating tabs 209 always remain in engagement with a wedge 218 of the spider and do not engage and disengage the wedges 218 as with the embodiment of FIGS. 32, 45 and 46.

s. Ring Gear

Figure 7:
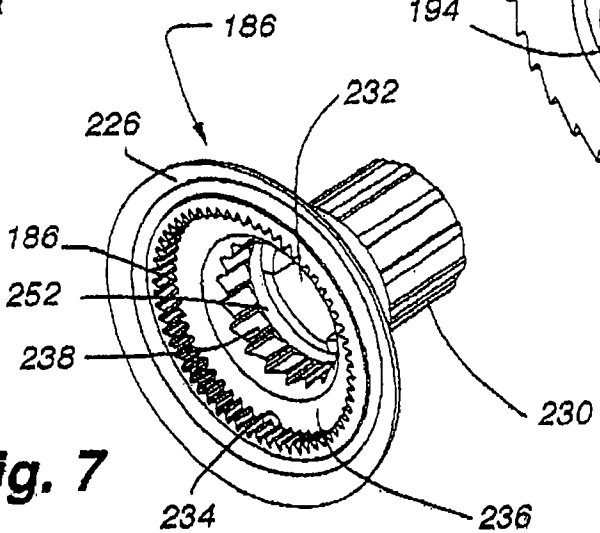
FIG. 7 is an isometric of the ring gear of the control system.
Figure 5:
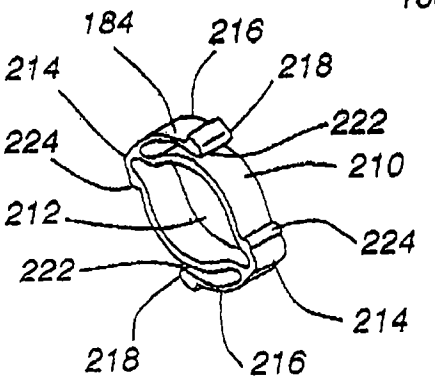
FIG. 5 is an isometric of a spider component of the control system.
Figure 12:
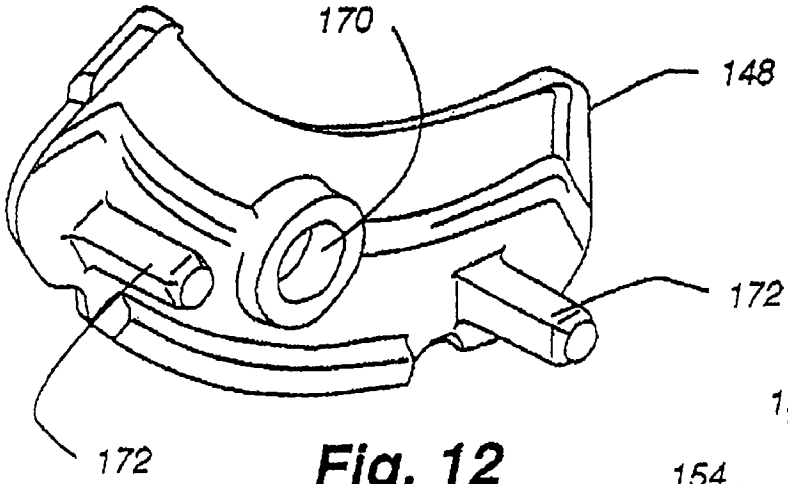
FIG. 12 is an isometric looking at the rear side of a cover plate for the pivot arm of FIGS. 10 and 11.

As previously mentioned, depending upon which direction the user pulls on the pull cord 28, either the four planet gears 182 or the spider 184 cause the ring gear 186 to rotate in either a clockwise direction or a counterclockwise direction, respectively. As shown in FIGS. 3 and 7, the ring gear is defined by a flanged portion having a first side 226 and a second side 228 with a cylindrical portion 230 extending from the second side. A cylindrical opening 232 passes through the flanged portion and the cylindrical portion. As shown in FIG. 7, the first side of the flanged portion is largely open ended having a first geared lip 234 adapted to engage the four planet gears on the planet carrier. Moreover, the first geared lip is slightly raised from the first side of the flanged portion to form a flange bearing surface 236. The flange bearing surface is adapted to cooperate with a circular groove on the second side of the planet carrier to create a bearing surface as well as an axial support between the planet carrier and the ring gear (see FIG. 15).

Figure 41:
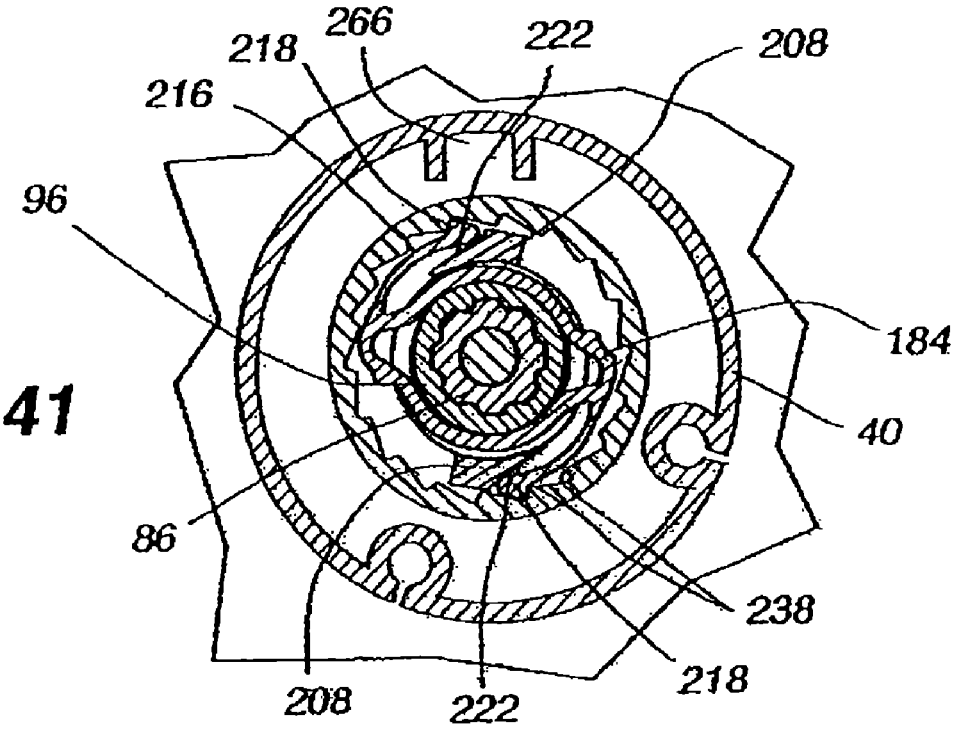
FIG. 41 is a section taken along line 41-41 of FIG. 37.

As shown in FIGS. 3 and 7, a second geared lip 238 is located interiorly of the first geared lip 234. The second geared lip has a smaller diameter than the first geared lip and is adapted to engage the spider wedges 218. As previously mentioned, the legs 216 of the spider are flexible. As shown in FIG. 41, counterclockwise rotation of the planet carrier 128 moves the two actuator tabs 208 into engagement with the two legs on the spider 84. More particularly, the actuator tabs engage the spider such that the actuator tabs move between the wedges and the body of the spider 210 until the notches 222 on the actuator tabs engage the wedges, causing the legs of the spider to flex and bend outwardly from the body of the spider. As the legs flex and bend outwardly, the wedges are driven to engage the second geared lip 238 of the ring gear 186. Friction between the body of the spider and the first surface 98 of the axle 96 holds the body of the spider in a fixed position relative to the axle until the actuator tabs adequately engage the legs of the spider. The engagement of the wedges with the second geared lip surface is compressional in that the wedges are driven to fit the second geared lip by outward force of the expanded leg against the actuator tab 208. Continued rotation of the planet carrier and ring gear in a counterclockwise direction, enables the wedges to remain in a continued compressional engagement with the second geared lip. When the planet carrier rotates in the clockwise direction, friction between the spider body and the first surface of the axle overcomes friction between the actuator tabs and the spider legs, allowing the actuator tabs to disengage from the spider legs, which disengages the spider from the ring gear.

As shown in FIG. 3, the cylindrical portion 230 of the ring gear 186 is defined by three elevated sleeve extensions. A first sleeve extension 240 extends from the second side 228 of the flanged portion. A second sleeve extension 242 extends from the first sleeve extension and has a diameter smaller than the first sleeve extension. A third sleeve extension 244 extends from the second sleeve extension and has a diameter smaller than the second sleeve extension. Further, the third sleeve extension includes an U-shaped channel 246 formed therein with two side walls 248 extending from the second sleeve extension to the end of the third sleeve extension. As discussed below, the two side walls function to cooperate with the braking system 250.

As shown in FIG. 3, a shoulder 252 located near the second geared lip 238 is defined by the connection of the third sleeve extension 244 and the second sleeve extension 242. The shoulder is adapted to cooperate with the flange 100 of the axle 96 to create a thrust bearing between the ring gear 186 and the axle. When the ring gear is mounted on the second surface 102 of the axle, the shoulder contacts the flange at an area just outside the circumference of the second surface spacer. As such, the second surface spacer helps to maintain the alignment of the axle with the ring gear by maintaining the shoulder in an appropriate thrust bearing position.

t. Summary of Transmission

To summarize the operational description of the transmission 80, as a user pulls on the pull cord 28 to move the covering in the desired direction, the pull cord is unwound from the cord spool 88, causing the cord spool and the sun gear to rotate in a counterclockwise direction (see FIG. 16). If the user pulls the pull cord in the upward operating direction (see FIGS. 25 and 30) the shift arm 83 is allowed to pivot such that the pawl tooth 164 on the shift arm engages the ratchet teeth 181 on the planet carrier, which prevents the planet carrier from rotating. As such, the counterclockwise rotation of the sun gear 186 causes the four planet gears 182 to rotate in a clockwise rotation about their respective axles (see FIG. 31). The rotating planet gears in turn engage the first geared lip 234 of the ring gear to cause the ring gear to rotate in a clockwise direction. Clockwise rotation of the ring gear, which engages the output assembly (see FIG. 31), causes the head roller 40 to rotate in a clockwise direction to wrap the covering onto the head roller.

Alternatively, if the user pulls the pull cord 28 in the downward operating direction (see FIGS. 35 and 40), the shift arm 83 is prevented from pivoting to engage the pawl tooth 164 with the ratchet teeth 181 on the planet carrier. This allows the planet carrier to rotate freely about the first surface of the axle 96. As such, counterclockwise rotation of the sun gear initially causes clockwise rotation of the four planet gears 182 about their respective axles as the four planet gears orbit counterclockwise about the axis of the sun gear due to the planet carrier rotating counterclockwise as a result of frictional resistance between interfacing surfaces of the planet carrier and the cord spool 88.

After the planet carrier has rotated counterclockwise for a brief period, the two actuator tabs 208 of the planet carrier eventually engage the legs 216 on the spider to turn the spider 184 in a counterclockwise direction. The actuator tabs cause the legs of the spider to bend outwardly away from the body 210 of the spider until the wedges 218 on the distal ends of the legs are compressed by the actuator tabs against the second geared lip 238 of the ring gear. As a result, the spider engages the ring gear 186 to turn it in a counterclockwise direction, as can be understood from FIG. 41. At this time, the four planet gears 182 cease to rotate about their respective axles and simply continue to orbit counterclockwise about the axis 206 of the sun gear as the planet carrier rotates counterclockwise. Adequate engagement of the planet carrier with the spider to facilitate the cord spool 88, planet carrier and ring gear turning counterclockwise as one integral unit is made possible by the resistance to motion of the ring gear by frictional drag associated with the wrap springs 188. Counterclockwise rotation of the ring gear 186, which engages the output assembly, causes the head roller 40 to rotate in a counterclockwise direction to unwrap the covering 16 from the head roller (see FIGS. 41 and 42).

Once the user releases tension from the pull cord 28, the clock spring 84 recoils the operating cord 29 onto the cord spool 88 in a clockwise direction. As the cord spool recoils, the planet carrier moves in a clockwise direction. Rotation of the planet carrier in a clockwise direction disengages the wedges on the spider legs 216 from the actuator tabs 208 on the planet carrier. As such, the legs contract to their original position relative to the spider body 210, which disengages the wedges from the second geared lip 238. Disengagement of the wedges from the second geared lip causes the rotation of the ring gear 186 to cease.

u. Output Assembly Overview

The structure and operation of the output assembly 82 will now be discussed in detail. As shown in FIG. 3, the output assembly includes the fastener 254, two wrap springs 188 rotatably supported on the third surface 104 of the axle 96, and the rotator spool 74 supported by the cylindrical portion 230 of the ring gear 186. These components engage to convert rotational movement of the ring gear into rotational movement of the head roller 40. As discussed in more detail below, a user pulling on the pull cord 28 in the upward operating direction (see FIGS. 24 and 30), causes the ring gear to rotate in a clockwise direction, which causes the rotator spool and the head roller to rotate in a clockwise direction. Alternatively, a user pulling the pull cord in the downward operating direction (see FIGS. 35 and 39) causes the ring gear to rotate in a counterclockwise direction, which causes the rotator spool and the head roller to rotate in a counterclockwise direction.

As shown in FIGS. 3, 20, 33 and 42, the two wrap springs 188 of the spring clutch 250 are adapted to receive the third surface 104 of the axle 96. It is to be appreciated that the number of wrap springs used may vary for different embodiments of the present invention. The inside diameters of the wrap springs are slightly smaller than the outside diameter of the third surface of the axle, which provides a frictional engagement between the second surface and the wrap springs. This frictional engagement enables a braking action for the ring gear 186. When the ring gear is mounted on the axle, the third sleeve 244 extension surrounds the wrap springs such that wrap spring tangs 256 extend outwardly from the wrap springs near the side walls 248 inside the U-shaped channel 246.

Still referring to FIGS. 3, 20, 33 and 42, the braking effect of the wrap springs 188 is released by the side walls 248 of the U-shaped channel 246 in the third sleeve extension 244 of the ring gear engaging one or a plurality of wrap spring tangs 256. As such, the rotational force of the side walls against the wrap spring tangs causes the wrap springs to expand, thereby loosening their frictional engagement on the third surface 104 of the axle. The reduced frictional engagement allows rotation of the ring gear 186. However, as the force imparted on the wrap spring tangs lessens, the wrap springs contract, thereby tightening their frictional engagement on the third surface of the axle, which provides a braking response. As well as holding the covering in a particular position, engagement of the side walls 248 against the wrap spring tangs also helps to prevent the ring gear from turning too quickly when the user is pulling on the pull cord 28.

As previously discussed, the diameter of the shoulder of the ring gear is slightly larger than the diameter of the third surface spacer on the axle. As such, the wrap spring closest to the spacer is prevented from becoming lodged under the shoulder as the ring gear rotates. This may be an important function when more than two wrap springs 188 are fitted about the third surface 104 of the axle. In addition, an end lip 258 on the interior of the third sleeve extension 244 is adapted to cooperate with a second surface shoulder 107 of the axle when the axle is inserted therethrough, which helps to prevent the wrap springs 188 from moving in a longitudinal direction along the second surface of the axle.

v. Rotator Spool

Figure 14:
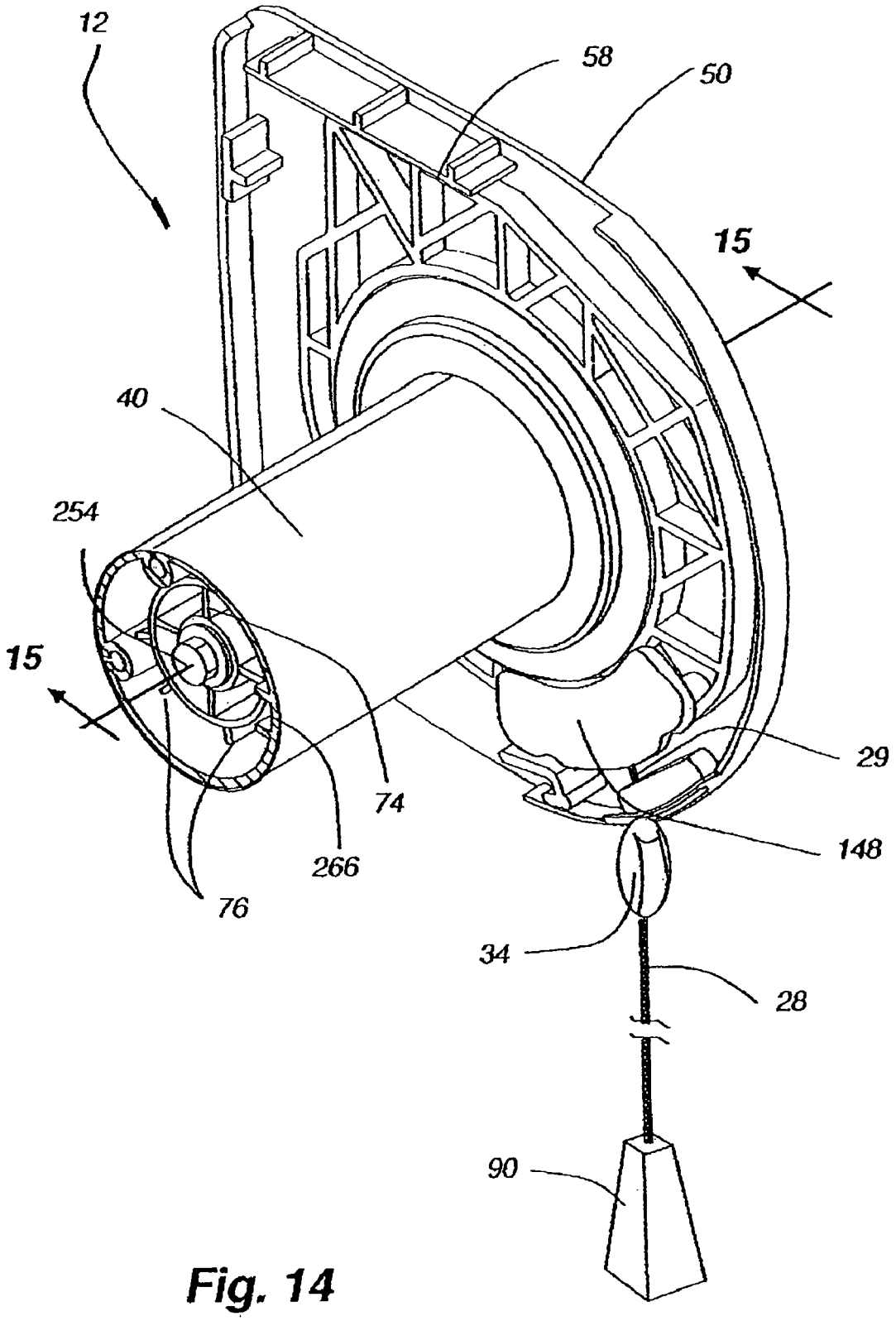
FIG. 14 is an enlarged fragmentary isometric showing the right end cap of the head rail with the control system of the present invention mounted thereon.
Figure 42:
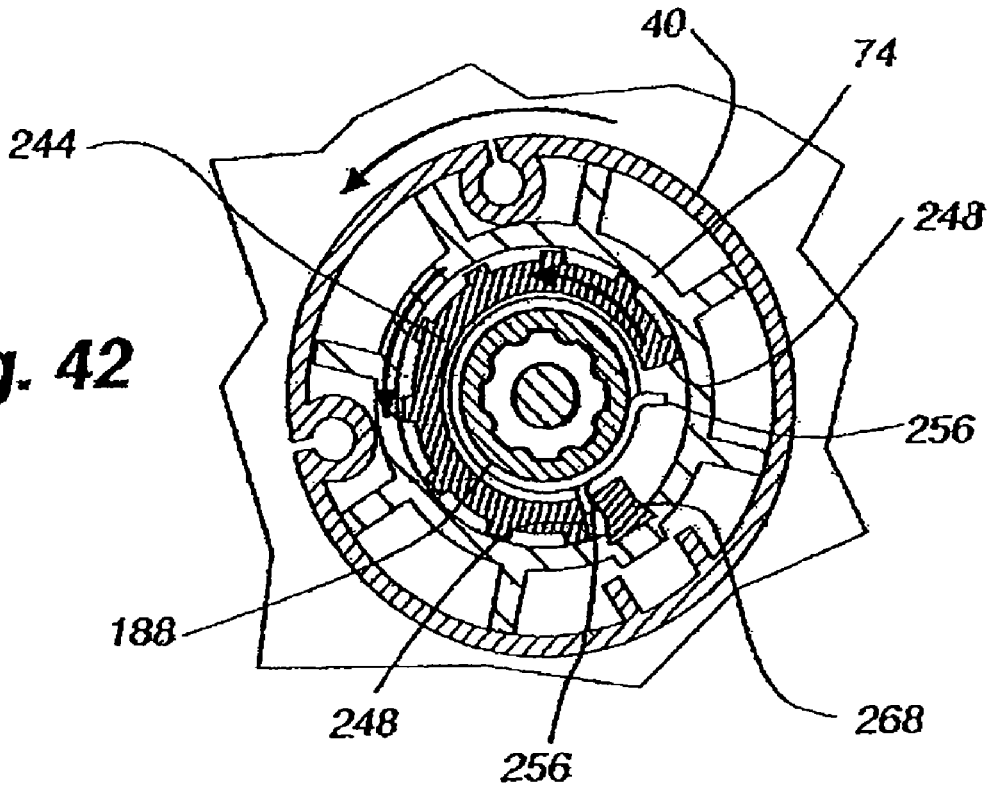
FIG. 42 is a section taken along line 42-42 of FIG. 37.

As shown in FIGS. 3, 14 and 42, the cylindrically-shaped rotator spool 74 includes a brake housing portion 262 having a hollow interior at an open end 264. Radially spaced longitudinal fins 76 are located on the outside of the rotator spool. A first longitudinal fin 264 is adapted to fit within the longitudinal inner groove 266 of the head roller, as shown in FIG. 14. A longitudinal boss 268 is adapted to connect with the interior of the brake housing portion. Referring back to FIGS. 3,14, and 42, the brake housing portion of the rotator spool is adapted to be placed over the third sleeve extension 244 of the ring gear so the longitudinal boss fits into the U-shaped channel 246 between the wrap spring tangs near the side walls 248. As such, when the ring gear rotates in either a clockwise or counterclockwise direction, the longitudinal boss 268 of the brake housing portion of the rotator spool engages the side walls of the U-shaped channel. Thus, the rotator spool rotates in the same direction as the ring gear.

As shown in FIG. 14, the rotator spool 74 is secured to the axle 96 by the fastener 254 to maintain a thrust connection between the components of the control system 12. More particularly, the fastener enters an opening 108 in the rotator spool and passes through the center of the axle 96 and screws into the first end cap shaft. When the components of the control system are assembled on the axle and the axle is installed on the first end cap shaft, the second end of the axle extends a slight distance outwardly from the opening of the rotator spool. In one embodiment, the axle extends 0.015 inches outwardly from the opening of the rotator spool. As such, when the fastener is screwed into the first end cap shaft, the screw head does not press against the rotator spool. As a result, the rotator spool is able to freely rotate.

w. Overall Summary

The above-described control system 12 assembled on the right end cap 50 of the head rail assembly, as shown in FIGS. 3, 4 and 14, allows a user to raise or lower the covering 16 by pulling on the pull cord 28 in either the upward operating pull direction or the downward operating pull direction. The control system also allows the user to pull repetitively on the pull cord in the same direction to achieve the desired position of the covering. Once the user releases the pull cord, the control system automatically retracts the pull cord back into the head rail assembly, and the braking system holds the covering in position.

Although this invention has been described above with a certain degree of particularity or with reference to one or more individual embodiments, those skilled in the art could make numerous alterations to those disclosed embodiments without departing from the spirit or scope of this invention. It is intended that all matter contained in the above description and shown in the accompanying drawings shall be interpreted as illustrative only of particular embodiments, and not limiting. Changes in detail or structure may be made without departing from the basic elements of the invention as defined in the following claims.

What is claimed is:

1. A retractable covering for an architectural opening including in combination:

a flexible fabric movable between extended and retracted positions, a roller about which said fabric can be wrapped in said retracted position or unwrapped in said extended position, and a control system for reversibly rotating said roller to move said fabric between said extended and retracted positions, said control system comprising an operating cord; and a shift arm operably associated with the roller and said operating cord, said shift arm including a stirrup defining a vertically extending passage and having a cross member, and extending from a first end of said shift arm, a pawl extending from a second end of said shift arm, said operating cord received through said vertically extending passage; and wherein said operating cord is pulled substantially straight downwardly to move said pawl to an engaged position and allow said roller to rotate in a first direction and said operating cord is pulled downwardly and away from said fabric in a plane substantially perpendicular to said fabric to engage said operating cord with said cross member and move said pawl to a disengaged position and allow said roller to rotate in the opposite direction.

2. The retractable covering of claim 1 wherein said shift arm is pivotal between two distinct positions about an axis substantially parallel with a longitudinal axis of said roller.

3. The covering of claim 2 wherein said shift arm has an arcuate surface across which said operating cord frictionally passes.

4. The covering of claim 2 wherein said shift arm includes a passage therethrough and through which said operating cord extends, said passage defining an engagement surface against which said operating cord can be moved to pivot said shift arm.

5. The covering of claim 3 wherein said arcuate surface has a groove therein for receipt of said operating cord.

6. The covering of claim 5 wherein said shift arm further includes guide fingers for frictionally and slidably engaging said operating cord in said groove and when said operating cord is pulled substantially straight downwardly both of said guide fingers engage said operating cord.

7. The covering of claim 4 wherein said arcuate surface has a groove therein for receipt of said operating cord.

8. The covering of claim 7 wherein said shift arm further includes guide fingers for frictionally and slidably engaging said operating cord in said groove and when said operating cord is pulled substantially straight downwardly both of said guide fingers engage said operating cord.

9. The covering of claim 2 wherein said control system further includes a ratchet wheel and said shift arm includes a pawl tooth such that positioning of said shift arm in said one position causes said pawl tooth to engage said ratchet wheel and positioning of said shift arm in the other position causes said pawl tooth to be disengaged with said ratchet wheel.

10. The covering of claim 6 wherein said guide fingers are offset from each other so as to define serpentine passage therebetween.

11. The covering of claim 6 wherein said guide fingers define a V-shaped passage therebetween through which said operating cord extends.

12. A control system for extending and retracting an architectural covering, comprising:

a pull cord; and a shift arm comprising:

a stirrup extending from a first end having a cross member and defining a generally vertically extending passage that receives the pull cord;

a pawl tooth extending in an opposite direction from the stirrup; and a pair of guide fingers positioned at least partially adjacent each other and extending from a top surface of the shift arm that engage the pull cord;

a planet carrier operably associated with the shift arm;

a roller configured to rotatably support the architectural opening and operably associated with the planet carrier; wherein when the pull cord is pulled straight downward, the pawl arm pivots to engage the planet carrier; and when the pull cord is pulled downward and away from the architectural covering in a plane substantially perpendicular to the architectural covering, the pull cord engages the cross member and the pawl arm pivots to disengage the planet carrier.

13. The control system of claim 12, wherein when the pull cord is pulled, the pull cord fictionally engages the pair of guide fingers to cause the shift arm to pivot from a first position to a second position.

14. The control system of claim 12, wherein the shift arm further comprises a groove underlying the pair of guide fingers, the groove receiving the pull cord as it exits the vertically extending passage.

15. The control system of claim 14, wherein the guide fingers are spaced on adjacent sides of the groove and are either offset from each other or aligned with each other.

16. The control system of claim 12, further comprising:

an end cap having at least one pocket wall operably connected a first end of the roller; and a cover plate operably connected to the shift arm and the end cap; wherein the cover plate and the at least one pocket wall cooperate to define a pocket, and the shift arm is at least partially received within the pocket.

17. The control system of claim 16, wherein the pocket wall engages at least a portion of the shift arm when the pull cord is pulled straight downward.

18. The control system of claim 17, wherein the pocket wall engages the pawl tooth when the pull cord is pulled straight downward.

* * * * *